US009758996B2

(12) United States Patent
Olsson et al.

(10) Patent No.: US 9,758,996 B2
(45) Date of Patent: Sep. 12, 2017

(54) LATCH

(71) Applicants: Ashley Dean Olsson, Goulburn (AU); Ashley Norman Olsson, Sumner Park (AU); Nathanael Dean Olsson, Sumner Park (AU); Stafford James Olsson, Sumner Park (AU); Kieran Blake Olsson, Sumner Park (AU); Reginald Trethewey, Deepwater (AU)

(72) Inventors: Ashley Dean Olsson, Goulburn (AU); Ashley Norman Olsson, Sumner Park (AU); Nathanael Dean Olsson, Sumner Park (AU); Stafford James Olsson, Sumner Park (AU); Kieran Blake Olsson, Sumner Park (AU); Reginald Trethewey, Deepwater (AU)

( * ) Notice: Subject to any disclaimer, the term of this patent is extended or adjusted under 35 U.S.C. 154(b) by 243 days.

(21) Appl. No.: 14/561,791

(22) Filed: Dec. 5, 2014

(65) Prior Publication Data

US 2015/0115623 A1 Apr. 30, 2015

Related U.S. Application Data

(63) Continuation-in-part of application No. PCT/AU2013/000577, filed on May 31, 2013.

(30) Foreign Application Priority Data

Jun. 5, 2012 (AU) ..... 2012902339

(51) Int. Cl.
*E05C 1/06* (2006.01)
*E05C 1/08* (2006.01)
(Continued)

(52) U.S. Cl.
CPC ..... *E05C 1/08* (2013.01); *E05B 17/0045* (2013.01); *E05B 65/0007* (2013.01); *E05C 1/10* (2013.01);
(Continued)

(58) Field of Classification Search
CPC ..... Y10T 292/0997; Y10T 292/0977; Y10T 292/0976; E05C 1/04
(Continued)

(56) References Cited

U.S. PATENT DOCUMENTS 1,318,988 A 10/1919 Good
1,419,230 A 6/1922 Crompton et al.
(Continued)

FOREIGN PATENT DOCUMENTS

| | | |
|---|---|---|
| DE | 202010008334 | 10/2010 |
| GB | 165139 | 6/1921 |
| GB | 1095541 | 12/1967 |

OTHER PUBLICATIONS

Downee, "Downee Rural Catalogue", Feb. 2009, pp. 1-17.
Supplemental European Search Report dated Nov. 13, 2015 in European Patent Application No. 13800833.

*Primary Examiner* — Mark Williams
(74) *Attorney, Agent, or Firm* — Byrne Poh LLP

(57) ABSTRACT

This invention relates to a latch (preferably a slam latch) and to methods of operating a door/gate/panel using the latch. The latch comprises: (i) a mounting body; (ii) a latch bolt mounted relative to the mounting body for movement between a locking position and an unlocking position, said latch bolt having a keeper-engaging region extending from the mounting body and terminating at a keeper-engaging end; and (iii) a keeper having at least a first wall and a second wall which are spaced to define an opening for receiving the keeper-engaging region, wherein the first and
(Continued)

second walls are adapted to engage the keeper-engaging region of the latch bolt when the latch bolt is in the locking position.

20 Claims, 17 Drawing Sheets

(51) Int. Cl.
*E05B 65/00* (2006.01)
*E05C 1/10* (2006.01)
*E05B 17/00* (2006.01)
*E05B 15/02* (2006.01)

(52) U.S. Cl.
CPC ..... *E05B 15/0205* (2013.01); *Y10T 292/096* (2015.04); *Y10T 292/1014* (2015.04); *Y10T 292/1016* (2015.04)

(58) Field of Classification Search
USPC ..... 292/138, 159, 165, 170, 169, 169.12, 292/169.14, 169.17, 182, 140
See application file for complete search history.

(56) References Cited

U.S. PATENT DOCUMENTS

| | | | | |
|---|---|---|---|---|
| 1,604,540 | A | 10/1926 | Taggart, Jr. | |
| 2,542,130 | A | 2/1951 | Friend | |
| 2,781,215 | A * | 2/1957 | Griffith | E05B 63/0069 292/148 |
| 2,810,824 | A * | 10/1957 | Kaufman | F21V 17/00 248/318 |
| 3,984,136 | A * | 10/1976 | Bills | E05C 1/06 292/182 |
| 5,887,928 | A | 3/1999 | Fenske | |
| 7,398,987 | B2 * | 7/2008 | Roe | B60D 1/28 280/515 |
| 7,878,558 | B1 * | 2/2011 | Bell | E05B 15/022 292/163 |
| 2004/0251694 | A1 | 12/2004 | Gorski | |

* cited by examiner

LATCH

CROSS REFERENCE TO RELATED APPLICATIONS

This application is a continuation-in-part of international application No. PCT/AU2013/000577, filed May 31, 2013 (which is hereby incorporated by reference herein in its entirety), which designates the United States and which claims priority from Australian provisional patent application No. 2012902339, filed Jun. 5, 2012 (which is hereby incorporated by reference herein in its entirety).

TECHNICAL FIELD

The present invention relates to a latch (preferably a slam latch) and to methods of operating a door/gate/panel using the latch. The following description particularly relates to slam latches, but it is to be understood that the invention is not limited to this type of latch.

BACKGROUND

Conventional slam latches contain a spring-loaded latch bolt which is caught, for example, within a keeper (striker plate) when a door or panel is closed or slammed shut. As a door or panel closes, the latch bolt strikes against an inclined surface or keeper being angulated towards the direction of bolt reciprocation. This causes the latch bolt to retreat within the main mounting body holding the latch bolt and simultaneously compresses a spring. The door or panel continues to close until the latch bolt aligns with an opening contained within a surface (especially a planar surface) of the keeper, allowing the spring-loaded bolt to propel outwards until the latch bolt is contained within the keeper opening, thereby securing the door or panel. The doors or panels are predominantly constructed of steel and, in agricultural applications, must be strong enough to safely restrain any animals being handled.

In agricultural applications in particular, such doors or panels are regularly slammed shut at high speed, and one hundred percent operating retention rates are required to maintain operational safety. There is often no other means to stop the swinging door or panel from over rotating and moving past the locking position apart from the spring-loaded latch bolt propelling outwards and locating within the keeper opening. If the latch is used in an animal pen or crush, for example, then failure for the latch-bolt to locate within the keeper opening could injure an animal if the door or panel over-rotated, or a human if an animal pressed against a door or panel which was not successfully locked, thereby pushing the door or panel into the human or allowing the animal to escape.

Consequently, slam latch bolts are conventionally accommodated in a keeper opening that is larger than the latch bolt. Due to the speed and momentum of the door or panel as it is closed, such an oversize keeper opening is designed to allow sufficient time for the spring loaded latch bolt to propel outwards and locate within the opening and prevent the door or panel from travelling past the opening. However, this excessive gap may cause a rattle which causes additional stress to an animal.

Furthermore, operators may prefer to guide or push a door or panel shut, and often this is achieved by the operator holding or maintaining contact with the handle of the slam latch. In these circumstances, the operator's hand in particular may be subjected to high impact shock stress. This may cause operators to use the slam latch by closing the door or panel with less control (as to avoid shock stress the operator may not maintain contact with the door or panel), or it may discourage long term use. Furthermore, if the operator holds on to the handle, this may occasionally impede the spring-return function of the latch bolt.

Similar problems may arise with other types of latches, or in non-agricultural applications. In commercial offices, for example, a door may be designed to move open at certain times, and at other times the door may be designed to be secured closed. Such a door may be, for example, a sliding door, a folding door, a door that swings open in one direction, or a door that swings open in two directions (in which the door is closed in a central position). Such a door may be made of glass or timber and only need to retain lesser loads than in agricultural applications, for example. When it is desired to secure the door closed, the latch bolt is released and moves to engage with a keeper. However, when such a door is secured closed there conventionally exists an excessive gap between the latch bolt and the keeper which allows the door to rattle and thereby cause a public disturbance. The rattle may also convey that the door is not held as securely as it could be if there was no rattle.

It is an object of the present invention to provide a latch which minimises or overcomes at least one of the disadvantages of conventional latches described above, or to provide the public with a useful or commercial choice.

SUMMARY

According to a first aspect of the present invention, there is provided a latch (preferably a slam latch) comprising: a latch bolt having a keeper-engaging end; and a keeper adapted to receive the keeper-engaging end of the latch bolt.

According to a second aspect of the present invention, there is provided a latch (preferably a slam latch) comprising: a mounting body; a latch bolt having a longitudinal axis and being mounted relative to the mounting body for axial movement relative to the mounting body between a locking position and an unlocking position, said latch bolt having a keeper-engaging region extending from the mounting body, wherein the keeper-engaging region is of decreased cross sectional area at a keeper-engaging end; and a keeper adapted to receive the keeper-engaging region of the latch bolt when the latch bolt is in the locking position.

According to a third aspect of the present invention, there is provided a latch (preferably a slam latch) comprising: a mounting body; a latch bolt having a longitudinal axis and being mounted relative to the mounting body for axial movement relative to the mounting body between a locking position and an unlocking position, said latch bolt having a keeper-engaging end extending from the mounting body; and a keeper having at least two spaced walls defining an opening having a mouth and a rear end, wherein the opening is adapted to receive the keeper-engaging end of the latch bolt when the latch bolt is in the locking position, wherein the spaced walls are closer together at the rear end than at the mouth.

According to a fourth aspect of the present invention, there is provided a latch (preferably a slam latch) comprising: a mounting body; a latch bolt having a longitudinal axis and being mounted relative to the mounting body for axial movement relative to the mounting body between a locking position and an unlocking position, said latch bolt having a keeper-engaging end extending from the mounting body; a latch bolt positioner comprising a latch bolt actuator, wherein the latch bolt actuator is pivotally mounted to the mounting body and operably connected to the latch bolt, wherein pivoting the latch bolt actuator moves the latch bolt between the locking position and unlocking position; and a keeper adapted to receive the keeper-engaging region of the latch bolt when the latch bolt is in the locking position.

According to a fifth aspect of the present invention, there is provided a latch (preferably a slam latch) comprising: a mounting body; a latch bolt having a longitudinal axis and being mounted to the mounting body for axial movement relative to the mounting body between a locking position and an unlocking position, said latch bolt having a keeper-engaging end extending from the mounting body; a handle extending laterally of the latch bolt; a latch bolt positioner operable by moving the handle against a biasing mechanism of the positioner to move the latch bolt axially into the unlocking position; and a keeper adapted to receive the keeper-engaging end of the latch bolt when the latch bolt is in the locking position.

According to a sixth aspect of the present invention, there is provided a latch (preferably a slam latch) comprising: a mounting body; a latch bolt having a longitudinal axis and being mounted to the mounting body for axial movement relative to the mounting body between a locking position and an unlocking position, said latch bolt having a keeper-engaging end extending from the mounting body; a handle extending substantially perpendicularly of the latch bolt and rotatable relative to the longitudinal axis; a latch bolt positioner operably connected to the latch bolt and handle, and operable by rotating the handle against a biasing mechanism of the positioner to move the latch bolt axially into the unlocking position; and a keeper adapted to receive the keeper-engaging end of the latch bolt when the latch bolt is in the locking position.

According to a seventh aspect of the present invention, there is provided a latch (preferably a slam latch) comprising: a mounting body; a latch bolt having a longitudinal axis and being mounted to the mounting body for axial movement relative to the mounting body between a locking position and an unlocking position, said latch bolt having a keeper-engaging end extending from the mounting body; and a keeper adapted to receive the keeper-engaging end of the latch bolt when the latch bolt is in the locking position.

According to an eighth aspect of the present invention, there is provided a latch comprising: a mounting body; a latch bolt having a longitudinal axis and being mounted relative to the mounting body for axial movement relative to the mounting body between a locking position and an unlocking position, said latch bolt having a keeper-engaging region extending from the mounting body and terminating at a keeper-engaging end; and a keeper having at least a first wall and a second wall which are spaced to define an opening for receiving the keeper-engaging region, wherein the first and second walls are adapted to engage the keeper-engaging region of the latch bolt when the latch bolt is in the locking position; wherein the latch bolt keeper-engaging region comprises a first side which first strikes the keeper second wall as the latch is closed, and said first side comprises a taper narrowing to the keeper-engaging end; and wherein the keeper first wall is angled so as to engage the taper when the latch closes to thereby minimise or eliminate rattling of the latch, wherein the latch is a slam latch.

According to a ninth aspect of the present invention, there is provided a latch comprising: a mounting body; a latch bolt being mounted relative to the mounting body for movement relative to the mounting body between a locking position and an unlocking position, said latch bolt having a keeper-engaging region extending from the mounting body and terminating at a keeper-engaging end; and a keeper having at least a first wall and a second wall which are spaced to define an opening for receiving the keeper-engaging region, wherein the first and second walls are adapted to engage the keeper-engaging region of the latch bolt when the latch bolt is in the locking position; wherein the latch bolt keeper-engaging region comprises a first side comprising a taper narrowing to the keeper-engaging end; and wherein the keeper first wall is angled so as to engage the taper when the latch closes to thereby minimise or eliminate rattling of the latch.

According to a tenth aspect of the present invention, there is provided a method of operating a gate/panel using the latch described herein.

Context allowing, the description below concerns the first to tenth aspects of the invention as defined above.

In one embodiment, the latch is a slam latch. However, in other embodiments the latch need not be a slam latch.

It is to be appreciated that the latch as described herein is particularly suited for securing doors and panels (especially swinging doors and swinging panels), particularly in agricultural applications (e.g. for handling livestock). Examples of livestock include alpaca, banteng, bison, camel, cattle, deer, donkey, gayal, goat, horse, llama, mule, pig, reindeer, sheep, water buffalo or yak; especially pigs, sheep, cattle or horses. The livestock may also weigh at least about 25 kg; especially at least about 30, 35, 40, 45, 50, 60, 70, 80, 90 or 100 kg; more especially at least about 150, 200, 250, 300, 350, 400, 450 or 500 kg. In another embodiment, the livestock may weigh at least about 550, 600, 650, 700, 750, 800, 850, 900, 950 or 1000 kg. The latch may be for use on a livestock enclosure, such as a pen, stall, crush or chute. The doors or panels in such agricultural applications may be made of any suitable material, but especially may be made of metal, such as steel or an alloy thereof.

In one embodiment, the latch is for use in handling livestock. For example, the latch may be for use in handling cattle, sheep, pigs or horses. In another example, the latch is for use in handling livestock, especially livestock weighing at least about 80 kg; more especially at least about 150 kg; most especially at least about 250 kg.

In another embodiment, the latch is capable of withstanding lateral forces applied by livestock (for example as defined above).

In another embodiment, the latch is used for locking doors or panels in an animal or livestock crush, especially a cattle crush.

The latch also has non-agricultural uses. Examples of non-agricultural uses include use of the latch on or with entry doors, connecting doorways and internal doors. Such doors may be located in residential homes, offices and other commercial installations, government buildings, warehouses, shopping centres, malls, transport terminals and hospitals. Such a door may be, for example, a sliding door, a folding door, a door that swings open in one direction, or a door that swings open in two directions (in which the door is closed in a central position). Such doors may be made of any suitable material, but especially of a polymer (such as plastic or vinyl), timber, glass, metals and metal alloys, or combinations thereof (including composite materials of wood and plastic, plastic and steel, steel and glass, alloy and glass and alloy and plastic).

One or a plurality of latches (for example 2, 3, 4, 5 or 6 latches) may be used on or with any one door or panel. For example, a plurality of latches may provide improved or adequate security and support for the door, especially in (for example) commercial installations.

In one embodiment, the latch is mountable to a door or panel, and the latch is capable of withstanding a load transverse (or lateral) to the longitudinal plane of the door or panel (especially perpendicular to the longitudinal plane of the door or panel) of at least about 50 kg, 100 kg, 150 kg, 200 kg, 250 kg, 300 kg, 350 kg, 450 kg, 500 kg, 600 kg, 700 kg, 800 kg, 900 kg, 1,000 kg, 1,250 kg, 1,500 kg, 2,000 kg, 2,250 kg, 2,500 kg, 2,750 kg or 3,000 kg. In another embodiment, the latch bolt has a longitudinal axis, and the latch is capable of withstanding a load transverse (or lateral) to the longitudinal axis (especially perpendicular to the longitudinal axis) of at least about 50 kg, 100 kg, 150 kg, 200 kg, 250 kg, 300 kg, 350 kg, 450 kg, 500 kg, 600 kg, 700 kg, 800 kg, 900 kg, 1,000 kg, 1,250 kg, 1,500 kg, 2,000 kg, 2,250 kg, 2,500 kg, 2,750 kg or 3,000 kg. In agricultural applications in particular it may be advantageous for the latch to be capable of withstanding higher transverse (or lateral) loads (for example so that the latch is capable of withstanding the weight of an animal). In non-agricultural applications it may also be advantageous for the latch to be capable of withstanding higher transverse (or lateral) loads, as this may improve the security of a door or panel.

The mounting body may be of any suitable size, shape and construction, and may be made of any suitable type of material or materials (such as plastics material or metal, such as steel).

In one embodiment, the mounting body comprises a mounting plate having upstanding (upturned) ends and the latch bolt may extend through an opening in each upstanding (upturned) end.

In an alternative embodiment, the mounting body comprises a mounting support and optionally a mounting cover. The spaced sides of the mounting support may define a channel/passageway for accommodating a latch bolt, especially a cuboid (rectangular) latch bolt. The mounting cover may be fastenable to the mounting support to define a channel/passageway for the bolt. In this embodiment, the bolt may be held in a single plane by the mounting body (which advantageously provides a more robust/sturdy latch that is less susceptible to bending moments). The mounting body may enclose all or almost all moving parts, leading to improved safety.

In a further embodiment the mounting body may have an opening for a key or other unique security device so as to allow the latch bolt to be secured by a locking mechanism to prevent un-authorised operation of the latch.

In a further embodiment, the mounting body may define a channel/passageway for accommodating a latch bolt, especially a cuboid (rectangular) latch bolt. In this embodiment, the mounting body may be integrally formed. For example, the passageway may be machined out of a solid piece of metal. In this embodiment, the bolt is held in a single plane by the mounting body (which advantageously provides a more robust/sturdy latch that is less susceptible to bending moments). The mounting body may enclose all or almost all moving parts, leading to improved safety.

The mounting body, plate or support may have at least one opening through which one or more fasteners may extend to mount the mounting body, plate or support to a gate, flap, door or other type of movable or hinged panel, or any type of fixture such as a post, jamb, wall or framework, for example. Alternatively, or additionally, the mounting plate may be welded to the gate, frame, flap door etc. Normally, the mounting body would be mounted to a moveable gate, flap, door or panel, whereas the keeper would be mounted to or integrated into a non-movable fixture such as a post, fence, pen or animal crush, for example. However, this arrangement may be reversed, such as where the mounting body may be on the non-movable fixture and the keeper may be mounted to a moveable gate, flap, door or panel.

The latch bolt may be of any suitable size, shape and construction, and may be made of any suitable type of material or materials (such as plastics material or metal (such as steel)). The latch bolt may be of any shape provided that it is long enough and able to be moved between the locking and unlocking positions. The latch bolt may be any suitable shape and may be a cylindrical and/or cuboid (rectangular) rod, pin or bar, for example. The latch bolt may also be arcuate, for example the latch may comprise two arcuate latch bolts extending from opposite sides of the mounting body, said two latch bolts being configured to engage with two opposed keepers such that the two latch bolt keeper-engaging regions are oriented transverse (or perpendicular) to the longitudinal plane of the latch mounting body.

The latch bolt may comprise a shaft region and a keeper-engaging region extending from the shaft region. The keeper-engaging region may terminate at a keeper-engaging end. The shaft region may be of any suitable shape, including cylindrical (round) or cuboid (rectangular). The keeper-engaging region (and the keeper engaging end) may also be of any suitable shape, including cylindrical (round) or cuboid (rectangular).

The latch bolt may be especially formed of a single, solid material, in which the material is especially metal, more especially steel. In one embodiment, the latch bolt has a cuboid (rectangular) shape overall, although it may include cut-outs or slots as discussed further below. In one embodiment, the latch bolt is "A" shaped, wherein an apex of the "A" is the keeper-engaging end.

In one embodiment, the keeper-engaging region may be of decreased cross-sectional area at the keeper-engaging end. In this embodiment, the keeper-engaging region may be tapered, bevelled or chamfered to an angle of about 4, 5, 6, 7, 8, 9, 10, 11, 12, 13, 14, 15, 16, 17, 18, 19 or 20 degrees relative to the longitudinal axis. The taper, bevel or chamfer may be approximately 3, 4, 5, 6, 7, 8, 9, 10, 11 or 12 mm in length (as measured along the longitudinal axis), but it need not be limited to this length. The keeper-engaging region may be tapered, bevelled or chamfered on one or more longitudinal sides, including 1, 2, 3 or 4 longitudinal sides, especially 1 or 2 longitudinal sides, more especially 2 opposed longitudinal sides. If the keeper-engaging region is tapered, bevelled or chamfered on more than one longitudinal side, the taper, bevel or chamfer may be the same on each longitudinal side or different.

In one embodiment, the keeper-engaging region includes a first side and a second side opposite the first side, and the first and/or the second sides may be tapered, bevelled or chamfered. In one embodiment, both said first side and said second side may be tapered, bevelled or chamfered. In a preferred embodiment, the keeper-engaging region is tapered, bevelled or chamfered on only one longitudinal side, especially on the first side. When the latch is a slam latch, the keeper-engaging region first side may be the longitudinal side that first strikes the keeper as the latch moves to a locking position (the keeper-striking side).

Typically, the shape of the keeper-engaging region will be snugly received within a suitably shaped opening in the keeper. The inventors have found that having large chamfered ends/angles on round keeper-engaging ends of latch bolts increase the potential for such ends to disengage their keepers when subjected to excessive side force. The inventors have further found that having too little an angle (i.e. about 3 degrees or smaller) results in the end actually wanting to "seize" (or "lock") in a mating taper of the keeper (i.e. morse-type tapers). The inventors have discovered that the optimal angle, on either round keeper-engaging ends or flat keeper-engaging ends, is anywhere between 4 degrees and 20 degrees, so as to provide an optimal locking result and at the same time providing adequate "break open" resistance.

Preferably, the keeper-engaging end is tapered, bevelled or chamfered to an angle of about 4 degrees to about 15 degrees relative to the longitudinal axis, and the length of the taper, bevel or chamfer is approximately 8, 9 or 10 mm in length (relative to the longitudinal axis). These dimensions increase the positive engagement and reduce the risk of the latch bolt "riding up" a rear/trailing wall or edge of the keeper (striker plate).

A region of the keeper and latch bolt may be subjected to significantly greater load when the latch is in use. For example, when the latch is mounted on an animal restraining door or cover, a region of the keeper and latch bolt which is furthest away from the animal may be placed under significant load if the animal presses against the door or cover. In this situation, the inventors have found that for cuboid latch bolts and rectangular keeper openings it is advantageous for the (longitudinal) side of the latch bolt keeper-engaging region that is furthest away from the animal to be planar (e.g. the second side of the latch bolt keeper-engaging region, or the side opposite the keeper-striking side), and the side of the keeper opening that engages with this side of the latch bolt keeper-engaging region (e.g. the keeper second wall) to also be planar. In this embodiment, the opposite side of the latch bolt keeper-engaging region (e.g. the first side) may be angled, for example, tapered, bevelled or chamfered. In fact, an angled latch bolt keeper-engaging region first side (which may be the side of the bolt that first contacts the keeper when the latch closes) may assist in closing the latch (especially when the door to which the latch is attached is moving at slower speeds).

In some embodiments, the latch further comprises a latch bolt positioner. The latch bolt positioner advantageously may be for moving the latch bolt between the locking position and the unlocking position. The latch bolt positioner may be of any suitable size, shape and construction, and may be made of any suitable type of material or materials (such as plastics material or metal (such as steel)). The positioner may comprise a single piece or two or more pieces that cooperate with one another. The positioner may be configured so that the latch automatically returns to the locking position, or the positioner may be configured to remain in whatever position (locking or unlocking position) set by the operator. The positioner may also comprise a locking mechanism to lock the latch in either the locking or unlocking position to thereby prevent unauthorised use of the latch.

The latch bolt positioner may comprise, for example, a cam and a cam follower in contact with one another. In one embodiment, the cam may be in the form of a collar or collet extending around a shaft region of the latch bolt, and a handle may be connected to the cam such that the cam may be rotated about the longitudinal axis. The cam may be a truncated cylinder or cylindrical wedge which bears against the cam follower. The cam follower may be in the form of a collar, collet or flange affixed to the shaft region. The cam follower may be a truncated cylinder or cylindrical wedge which bears against the cam. When the handle is used to rotate the cam about the shaft region of the latch bolt, the cam and cam follower are caused to axially separate and the keeper-engaging end is moved to the unlocked position.

In another embodiment, the cam may be in the form of a collar, collet or flange extending around and affixed to a shaft region of the latch bolt, and a handle may extend directly from the latch bolt such that the cam may be rotated when the handle is rotated. The cam follower may be in the form of a collar or collet extending around the shaft region of the latch bolt but affixed to the mounting body. The cam may be a truncated cylinder or cylindrical wedge which bears against the cam follower. The cam follower may be a truncated cylinder or cylindrical wedge which bears against the cam. When the handle is used to rotate the cam relative to the cam follower, the cam and cam follower are caused to axially separate and the keeper-engaging end is moved to the unlocked position.

In a further embodiment, the latch bolt positioner comprises a latch bolt actuator, wherein the latch bolt actuator may be pivotally mounted to the mounting body and operably connected to the latch bolt, such that pivoting the latch bolt actuator moves the latch bolt between the locking position and unlocking position. The latch bolt positioner may comprise a cam in the form of a latch bolt actuator pivotally mounted to the mounting body and a cam follower connected to the latch bolt, such that pivoting the latch bolt actuator moves the latch bolt between the locking position and unlocking position. In this embodiment, the latch bolt actuator (cam) may be especially mounted to the mounting body (especially the mounting support) by way of a pivot pin or bolt. When the latch is assembled, the latch bolt actuator may extend through a slot in the latch bolt. In this embodiment, the cam follower may be in the form of a roller pinned to the latch bolt. As the latch bolt actuator (cam) is pivoted, the actuator bears against the roller (cam follower) and moves the latch bolt between the locking position and unlocking position. The cam follower may be mounted at the end of the latch bolt (opposite to the keeper-engaging end) by a fastener (which may be, for example, a pin or bolt). The cam follower may be positioned within the slot in the latch bolt, such that the latch bolt actuator (cam) abuts the cam follower. As the latch bolt actuator is moved away from the keeper-engaging end of the bolt, the actuator (cam) moves against the cam follower so as to move the latch bolt to the unlocking position. The cam follower may be made of any suitable material, such as metal (e.g. steel) and plastics material, such as nylon. The cam follower may be especially made of nylon (which advantageously provides noise reduction compared to, for example, a steel cam follower). An advantage of this arrangement is that the latch bolt is capable of moving between the locking and unlocking positions without movement of the latch bolt actuator. This means that an operator may be able to hold the handle of the slam latch (which may be connected to the latch bolt actuator) without high impact shock stress, as the door or panel (for example) to which the slam latch is connected is slammed shut.

The latch bolt positioner may further comprise a biasing mechanism to bias the bolt to the locking position. Any suitable type of biasing mechanism may be used. For example the biasing mechanism may be a spring, such as a coiled spring/helical spring. In one embodiment, the spring may extend around a shaft region of the latch bolt. One end of the spring may bear against the mounting body (e.g. upstanding end) and the other end of the spring may bear against the keeper-engaging end of the latch bolt or the cam or of the positioner.

In another embodiment, the biasing mechanism (especially a spring) may be located within a suitably shaped slot in the latch bolt. In this embodiment, the biasing mechanism may be positioned so that one end abuts the latch bolt, and the other end abuts a stop pin that extends from the mounting support/body (the stop pin is especially connected or recessed into the mounting support/body). When the mounting body has a passageway/channel (formed, for example, by a mounting support and mounting cover), the biasing mechanism may be held in place by, for example, the mounting cover. When the bolt is moved into an unlocking position, the biasing mechanism may be compressed, such that the latch bolt will return to the locking position.

In some embodiments, the latch further comprises a latch bolt adjuster for adjusting the throw of the bolt. In one embodiment, the adjuster may be mounted to the bolt, for example at the opposite end to the keeper-engaging end. The adjuster may be of any suitable configuration. In one embodiment, the end of the bolt opposite to the keeper-engaging end is cylindrical and threaded, and together with a threadable nut functions as the adjuster. In this embodiment, turning the nut further onto the bolt reduces the throw, and turning the nut off the bolt increases the throw. Movement of the latch bolt adjuster may also advantageously adjust the tension of the biasing member. When the latch bolt positioner comprises a cam and a cam follower, the latch bolt adjuster may also alter the tolerances between the cam and cam follower to improve operation of the latch.

In some embodiments, the latch further includes one or more handles. The handle may be of any suitable size, shape and construction, and may be made of any suitable type of material or materials (such as plastics material or metal (including steel)). The handle may extend linearly or non-linearly. The handle may be substantially linear, L-shaped or substantially U-shaped. In one embodiment, the handle extends directly from the latch bolt. It may be of unitary construction with the latch bolt or it may be a separate connectable piece. In another embodiment, the handle is connected to the positioner or part thereof, and the handle may be especially connected to the latch bolt actuator (cam). The handle may be of unitary construction with the positioner (or part thereof) or it may be a separate connectable piece. When the handle extends from the latch bolt actuator, the handle can provide mechanical advantage to the operator in compressing the biasing member. This may allow for biasing members with improved compressive strength to be used in the latch. The latch may be configured to provide a handle on both sides of a door or panel.

The keeper may be of any suitable size, shape and construction, and may be made of any suitable type of material or materials (such as plastics material or metal (including steel and alloys thereof)). The keeper may have a body providing an opening for receiving the keeper-engaging region. As mentioned, typically, the shape of the keeper-engaging region (especially the keeper-engaging end) will be snugly received within a suitably shaped opening in the keeper body. The keeper body may be of unitary construction or may comprise two or more body pieces. Alternatively, the keeper body may be moulded into a non-movable fixture such as a post, fence, pen or animal crush, for example.

The keeper may have a body providing a blind opening (or it may not be blind but open, according to the method of manufacture) for snugly receiving the keeper-engaging end of the latch bolt.

In one embodiment, the keeper may have a pair of spaced walls (a first wall and a second wall opposite to the first wall) and the space between the walls may provide an opening for receiving the keeper-engaging end. Alternatively, in another embodiment, the keeper body may have a base and a pair of spaced walls that extend from the base, all of which define a blind opening for receiving the keeper-engaging end. For either embodiment, the spaced walls may have inner faces that begin to converge/extend towards one another (as they near the base or fixture to which the keeper is mounted) so as to provide a snug fit for the keeper-retaining end. In both embodiments, the keeper may have at least two spaced walls (especially two) defining an opening having a mouth and a rear end, wherein the opening is adapted to receive the keeper-engaging end of the latch bolt when the latch bolt is in the locking position, wherein the spaced walls are closer together at the rear end than at the mouth. For the avoidance of doubt, the term "rear end" merely refers to the end of the walls opposite to the mouth. The at least two spaced keeper walls may be a first keeper wall, and a second keeper wall opposite to the first keeper wall. The first keeper wall engages with the keeper-engaging region first side, and the second keeper wall engages with the keeper-engaging region second side.

If the latch bolt is cylindrical, then the bolt may be bevelled or chamfered (for example) at its end, and the walls of the keeper may be angled towards each other to minimise or eliminate a rattle in the latch. Alternatively, if the latch bolt is cuboid, then only one side may be bevelled or chamfered (for example). In this case, only one wall of the keeper may be angled towards the other wall, especially so as to conform to the angles of the bolt and to thereby minimise or eliminate a rattle in the latch. In one embodiment, the at least two walls of the keeper may be oriented to conform to the shape of the keeper-engaging region.

Preferably, the keeper-engaging end of the latch bolt does not come into contact with the base of the keeper body or fixture to which the keeper body is mounted because the latch bolt is biased to a locking position (for example by spring-loading) and, in agricultural situations for example, as an animal tries to move the panel or gate the biasing member ensures that the latch bolt continues to move outwards until it is wedged between the inner faces of the keeper walls thereby ensuring zero gap. The inventors have found this feature to be a major difference and advantage over known latches. The biased latch bolt moving outwards until it is wedged between the inner faces of the keeper walls may also prevent the latch from rattling in the wind (or glass doors from rattling in the wind), or prevent the latch from moving when force is applied to it by persons testing the security of the door.

At least one of the walls (front wall, leading wall or second wall) may have a sloping or ramped outer surface along which the keeper-engaging end may slide when moving to the opening in the keeper. The other wall (rear wall, trailing wall or first wall) may project out past the sloping or ramped wall so as to increase positive engagement of the keeper-engaging end with the keeper body. That is, the longer first wall may prevent the latch bolt from overshooting or otherwise not engaging the opening properly. The first wall may project out past the sloping or ramped wall by any suitable distance—for example, about 2, 3, 4, 5, 6, 7, 8, 9 or even 10 mm, but preferably about 4-8 mm. Preferably, when a handle is used to move the keeper-engaging end to the unlocking position, there is sufficient clearance so as to be able to move the keeper-engaging end past the other wall.

The base or keeper body in general may have at least one opening through which one or more fasteners may extend to mount the base or keeper body generally to a gate, flap, door or other type of fixed, movable or hinged panel, or any type of fixture such as a post, jamb, wall or framework, for example. Alternatively, or additionally, the base or keeper body in general may be welded or cast into the gate, frame, flap door etc. Again, normally, the keeper would be mounted to or integrated into (e.g. moulded into) a non-movable fixture such as a post, fence, pen or animal crush, for example.

BRIEF DESCRIPTION OF DRAWINGS

Various embodiments of the invention will now be described, by way of example only, with reference to the accompanying figures, in which.

In the Figures like reference numerals refer to like features.

DETAILED DESCRIPTION

Figure 1:
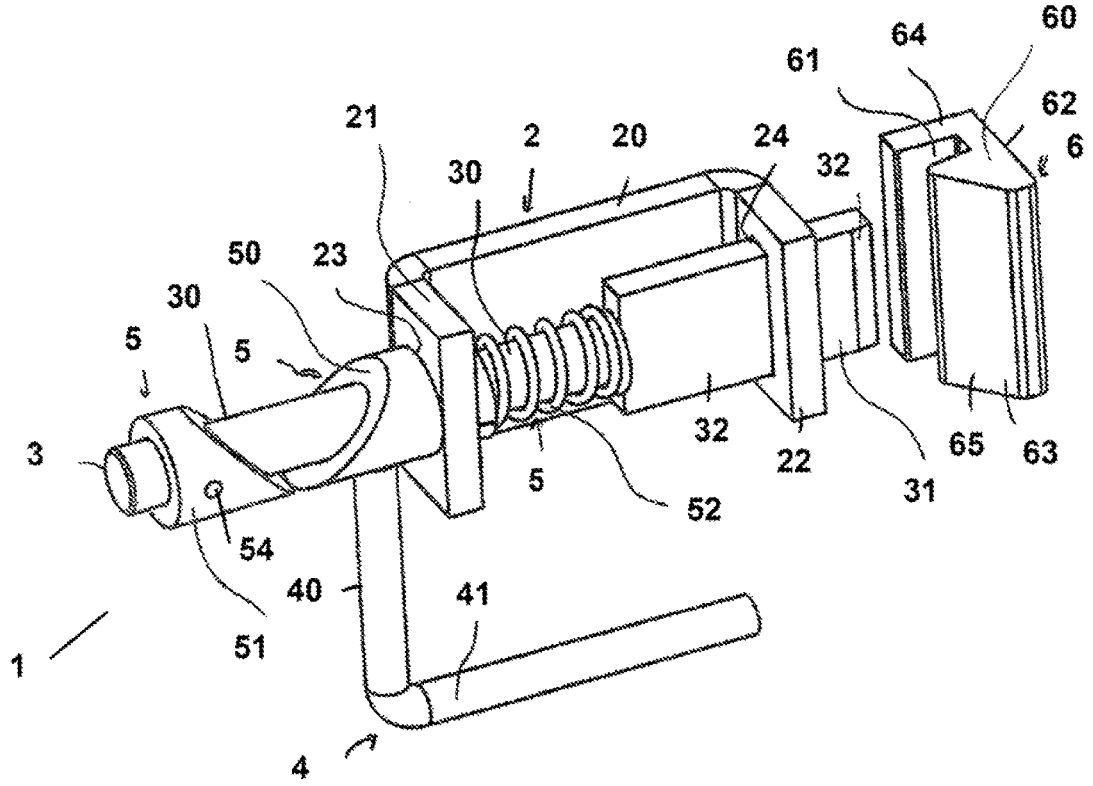
FIG. 1 is an isometric view of a latch shown having a latch bolt in an unlocked position, according to a first example of the present invention.
Figure 2:
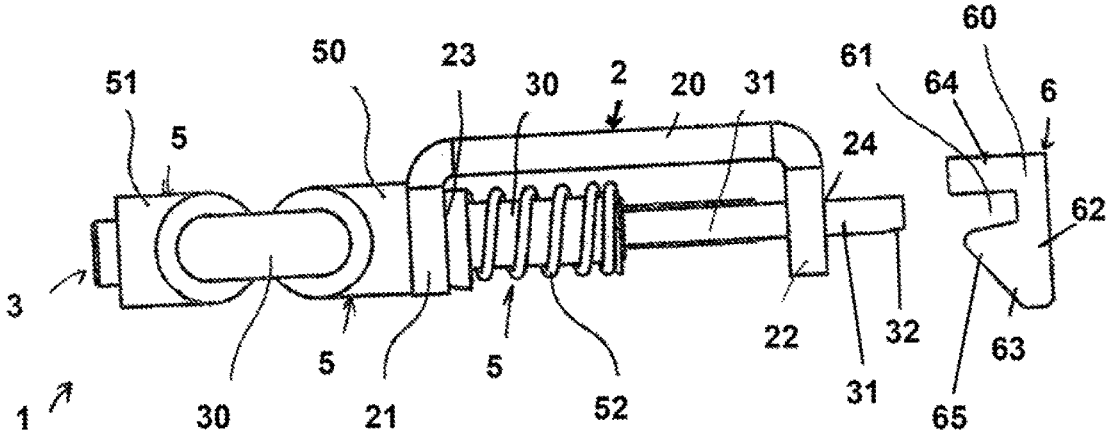
FIG. 2 is a plan view of the latch shown in FIG. 1.

Referring first to FIGS. 1 and 2, there is shown a slam latch 1 for locking a hinged gate (not shown) to a gate post (not shown), for example.

Although the slam latch as described herein is particularly suited for securing doors and swinging panels, particularly in agricultural applications (e.g. for handling livestock such as sheep, pigs, horses or cattle), it may have other non-agricultural commercial uses.

The slam latch 1 comprises a mounting body 2, a latch bolt 3, a handle 4, a latch bolt positioner 5 and a keeper 6.

The mounting body 2 comprises a steel mounting plate 20 having upstanding (upturned) ends 21, 22 and the latch bolt 3 extends through an opening 23, 24 in each upstanding end 21, 22. The mounting plate 20 has openings (not shown) through which fasteners (screws) extend to mount the mounting plate 20 to a hinged gate.

The latch bolt 3 has a longitudinal axis and is made of steel. The latch bolt 3 is mounted to the mounting body 2 for axial movement relative to the mounting body 2 between a locking position (not shown) and an unlocking position (as shown in FIGS. 1 and 2). The latch bolt 3 comprises a cylindrical shaft region 30 and a keeper-engaging end 31 extending from the shaft region 30. The keeper-engaging end 31 is in the form of a plate and has a chamfered/tapered edge 32 (keeper-engaging region second side) having an angle of about 4 to 8 degrees relative to the longitudinal axis and a length between about 3-12 mm (relative to the longitudinal axis).

The handle 4 is substantially L-shaped and is made of steel. One part 40 of the handle 4 extends substantially perpendicularly of the latch bolt 3 shaft region 30 and a free end 41 of the handle 4 extends substantially parallel with the longitudinal axis.

The latch bolt positioner 5 comprises a cam 50, a cam follower 51 and a biasing member 52, and the cam 50 and cam follower 51 are made of steel. The biasing member 52 is made of sprung steel.

The cam 50 is in the form of a collar extending around the shaft region 30 of the latch bolt and further through opening 23, and the handle 4, 40 is connected to the cam 50 such that the cam 50 may be rotated about the shaft region 30 (longitudinal axis). The cam 50 is a truncated cylinder/cylindrical wedge which bears against the cam follower 51.

The cam follower 51 is in the form of a collar extending around and affixed to the shaft region 30 of the latch bolt 3 by way of a fastener 54. Like the cam 50, the cam follower 51 is also a truncated cylinder/cylindrical wedge which bears against the cam 50.

The biasing member 52 is in the form of a coiled spring. The spring 52 is wound about the shaft region 30 of the latch bolt 3 between the upturned end 21 of the mounting bracket 2 (or cam 50) and the keeper-engaging end 31 of the latch bolt 3. The spring 52 ensures that the cam 50 and cam follower 51 are always kept in contact with one another as well as that the latch bolt 3 may return to the locked position when the handle 4 is released by an operator.

When the handle 4 is used to rotate the cam 50 about the shaft region 30 of the latch bolt 3, the cam 50 and cam follower 51 are caused to axially separate and the keeper-engaging end 31 is moved to the unlocked position—against the force of the spring 52—as shown in FIGS. 1 and 2. When the handle 4 is released, the cam 50 rotates so as to return the latch bolt 3 to the locked position.

The keeper 6 has a steel body 60 providing a blind opening 61 for snugly receiving the keeper-engaging end 31 of the latch bolt. The keeper body 60 has a base 62 and a pair of spaced walls 63, 64 (first wall 64 and second wall 63) that extend from the base 62, all of which define the blind opening 61. The spaced walls 63, 64 have inner faces that converge/extend towards one another as they near the base 62 so as to provide a snug fit for the keeper-retaining end 31. One of the walls 63 (i.e. the front wall, leading wall or second wall) has a sloping or ramped outer surface 65 along which the keeper-engaging end 31 slides when on its way to the blind opening 61 in the keeper 6. The other wall 64 (i.e. the rear wall, trailing wall or first wall) is approximately 4 mm longer than wall 63 (as shown at "A" in FIG. 6). The gap shown in "B" in FIG. 6 ensures positive locking.

The base 62 has openings (not shown) through which fasteners extend to mount the base 62 to a non-moving fixture such as a post, jamb, framework or other structure.

In use, the mounting body 2 is mounted to a hinged gate (or other type of movable panel) and the keeper 6 is mounted to a non-moving fixture such as a gate post, jamb, framework or other structure.

When the hinged gate is swung towards the keeper 6, the latch bolt 3 rides along and up over the sloping or ramped outer surface 65 of the keeper 6, and the spring 52 ensures that the keeper-retaining end 31 of the latch bolt 3 engages the opening 61 so as to lock the hinged gate to the gate post. In order to unlock the hinged gate, the handle 4 is rotated by an operator such that the cam 50 and cam follower 51 are axially separated, and the keeper-engaging end 31 disengages the keeper 6. When the handle 4 is released, the spring 52 ensures that the latch bolt 3 is again extended to the locking position.

Referring now to FIGS. 3 to 9, there is shown a slam latch 100 for locking a hinged gate (not shown) to a gate post (not shown), for example, according to another embodiment of the present invention.

The slam latch 100 comprises a mounting body 200, a latch bolt 300, a handle 400, a latch bolt positioner 500 (see FIG. 3) and a keeper 600.

The mounting body 200 comprises a steel mounting plate 220 having upstanding ends 221, 222 and the latch bolt 300 extends through an opening (not labelled) in each upstanding end 221, 222. The mounting plate 220 has openings (not shown) through which fasteners (screws) extend to mount the mounting plate 220 to a hinged gate.

Figure 3:
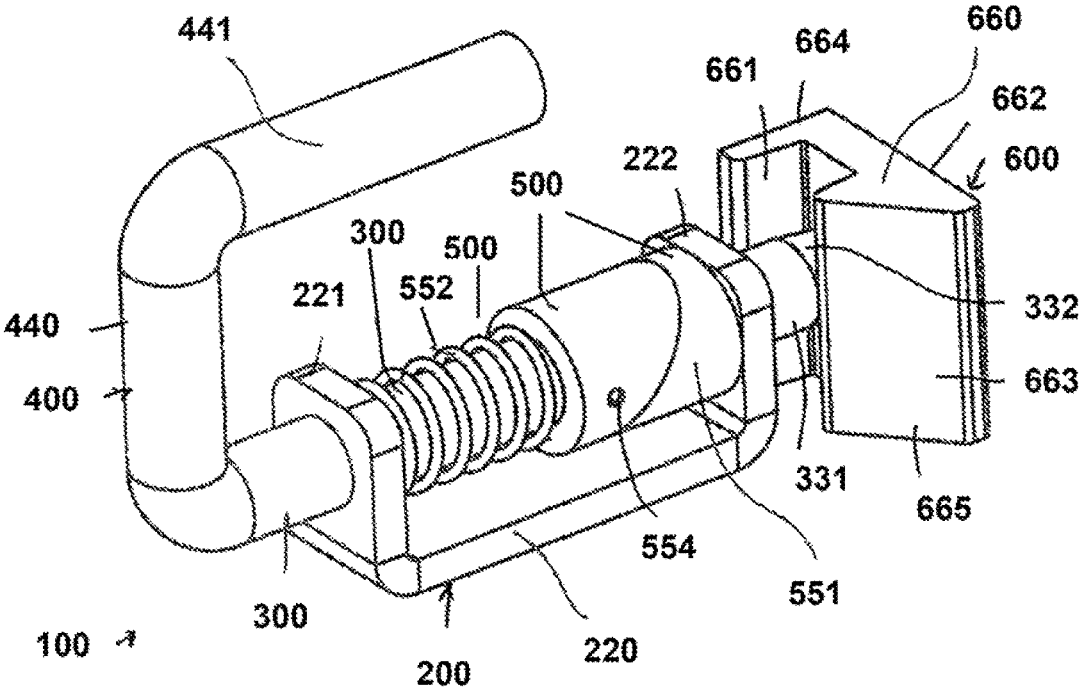
FIG. 3 is an isometric view of a latch shown having a latch bolt in a locking position, according to a second example of the present invention.
Figure 4:
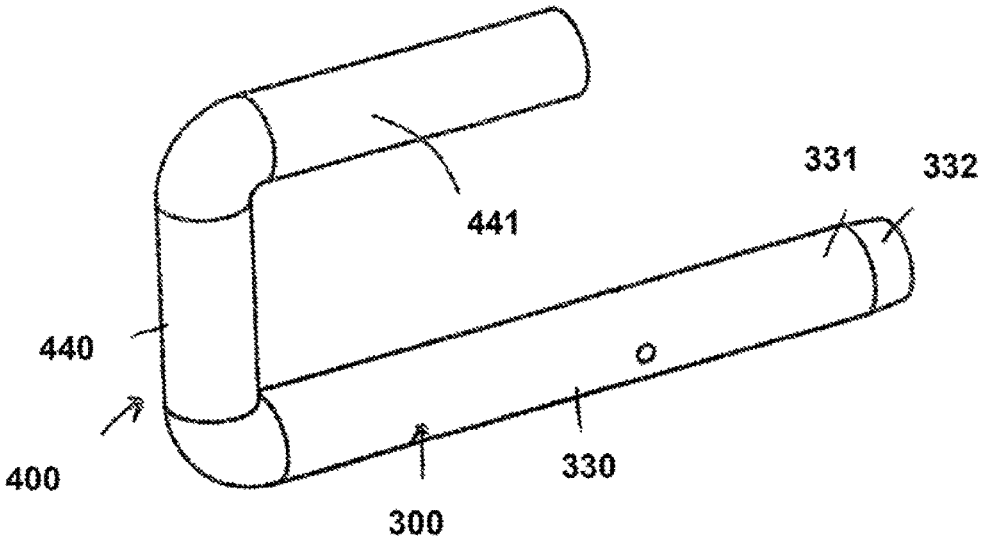
FIG. 4 is an isometric view of part of the latch shown in FIG. 3.
Figure 5:
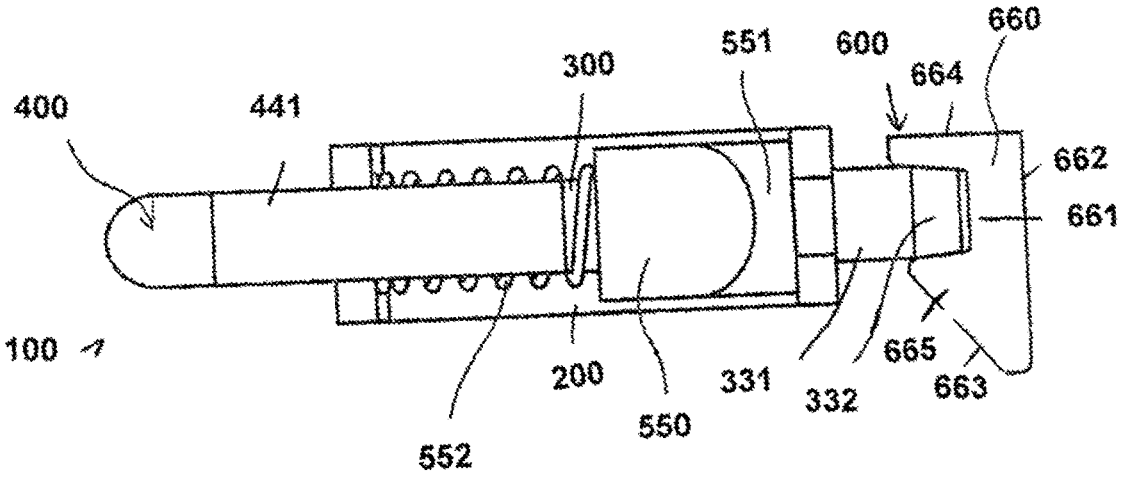
FIG. 5 is a plan view of the latch shown in FIG. 3.
Figure 6:
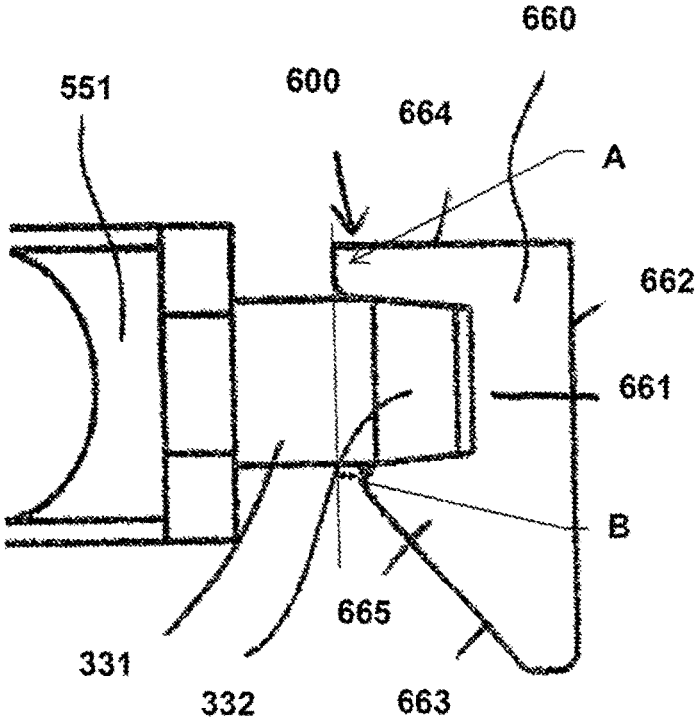
FIG. 6 is a close-up of the view shown in FIG. 5, in which the interaction between the keeper and keeper-engaging end of the latch bolt is illustrated.
Figure 7:
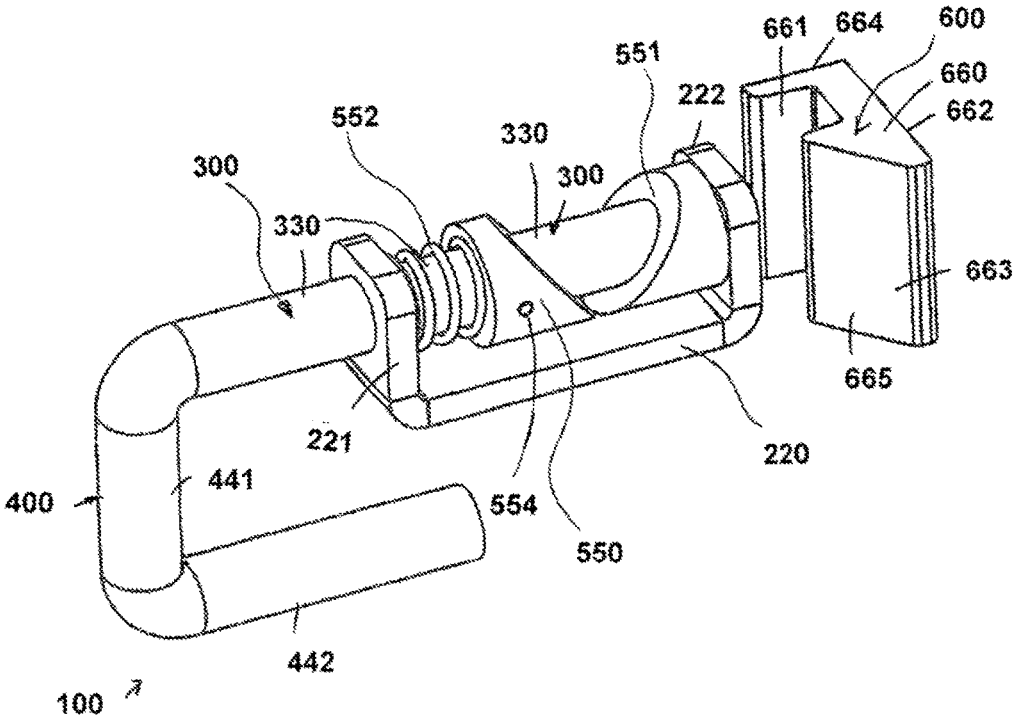
FIG. 7 is an isometric view of the latch shown in FIG. 3 but showing the latch bolt in an unlocking position.
Figure 8:
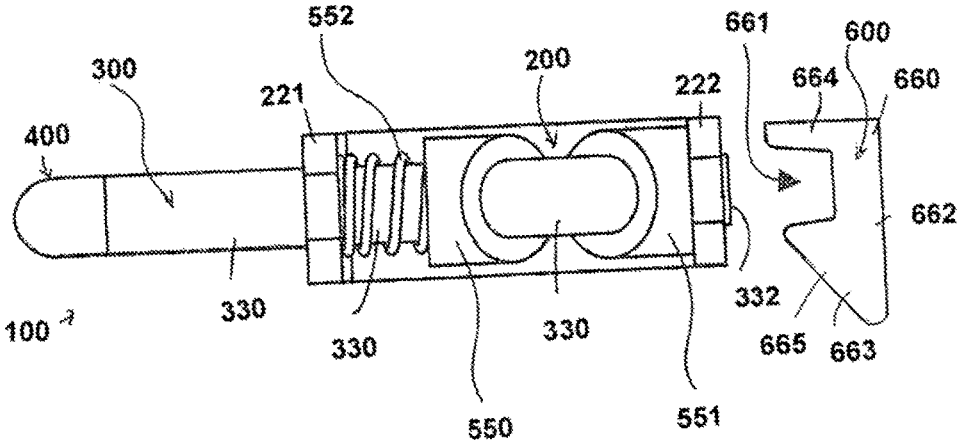
FIG. 8 is a plan view of the latch shown in FIG. 6.
Figure 9:
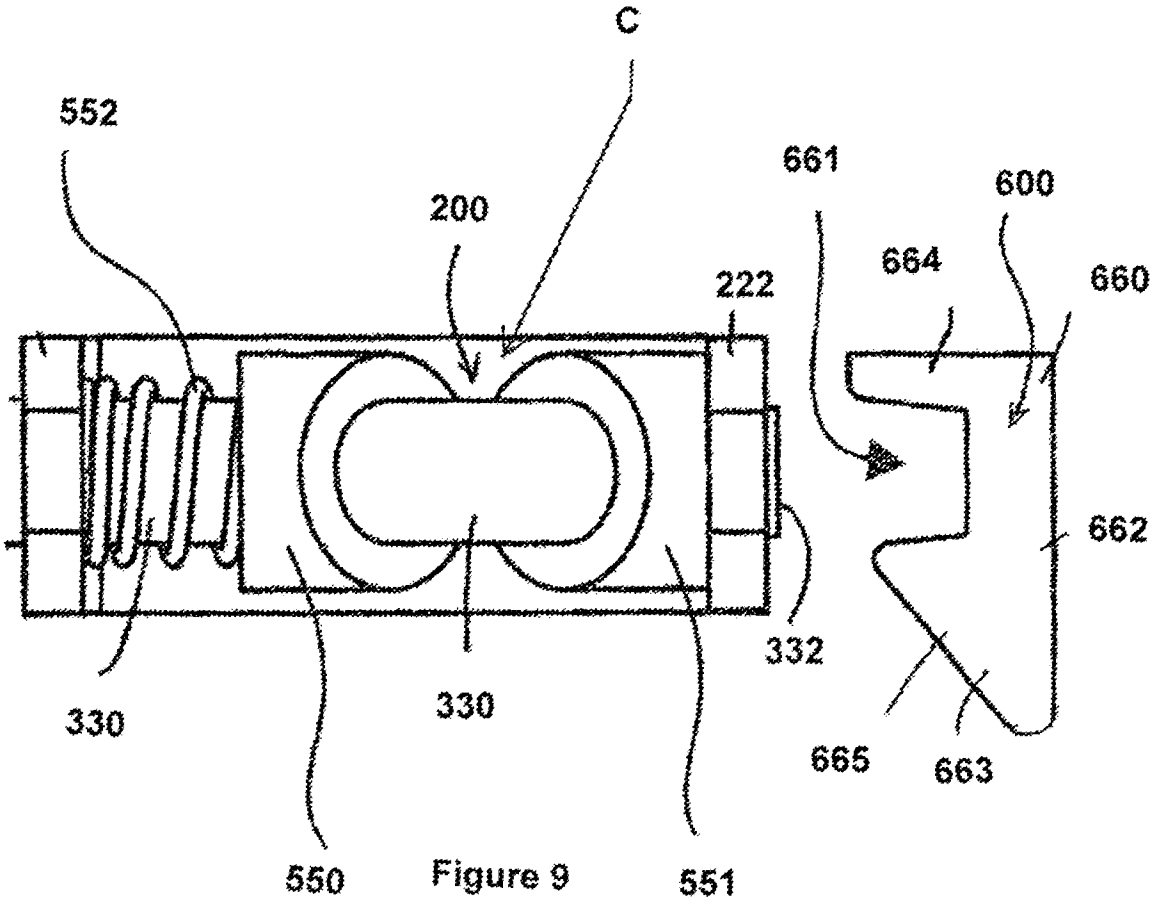
FIG. 9 is a close-up of the view shown in FIG. 8, illustrating the keeper and the latch bolt positioner.
Figure 10:
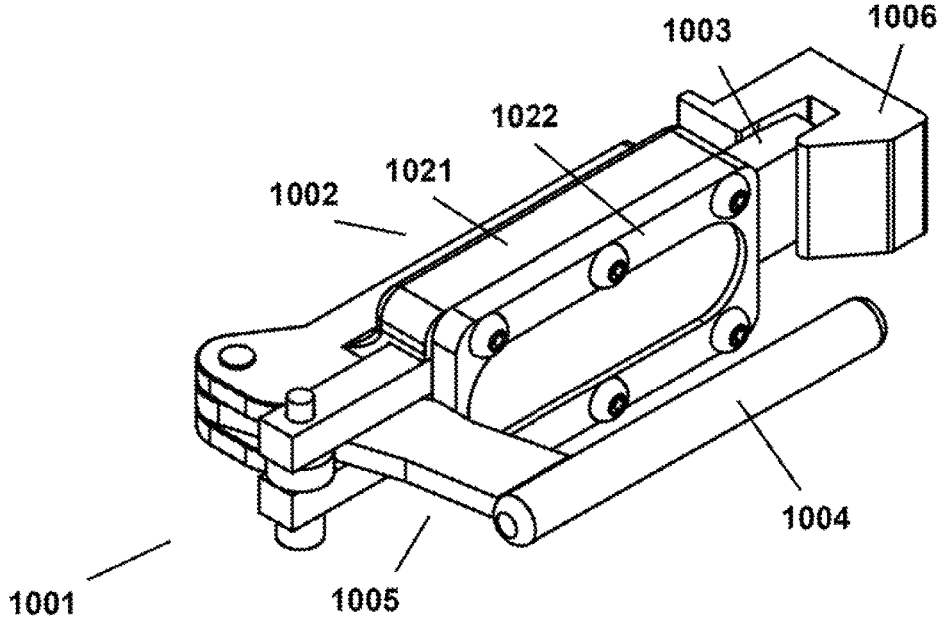
FIG. 10 is an isometric view of a latch shown having a latch bolt in a locking position, according to a third example of the present invention.
Figure 11:
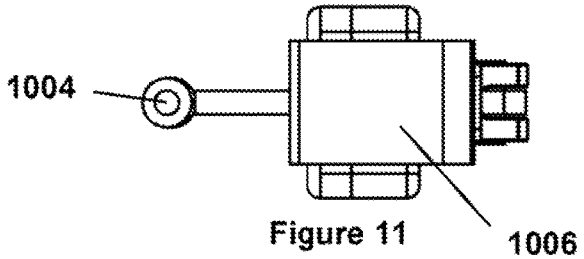
FIG. 11 is an end view (from the keeper end) of the latch shown in FIG. 10.
Figure 12:
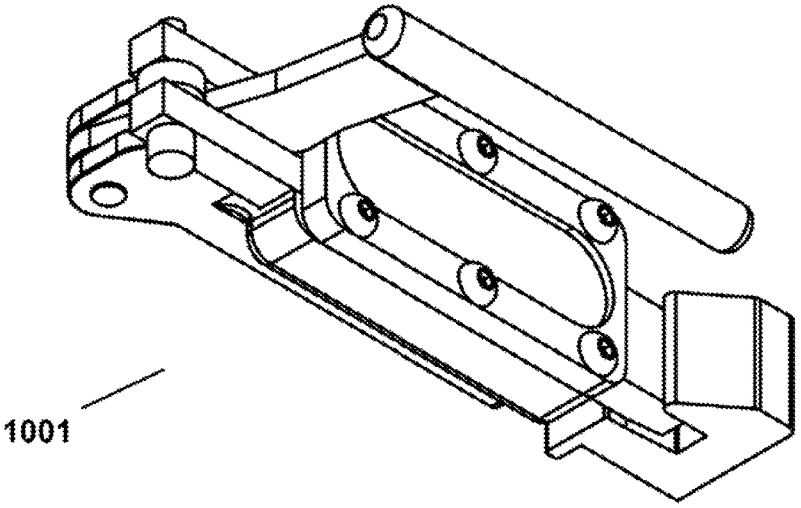
FIG. 12 is another isometric view of the latch shown in FIG. 10.
Figure 13:
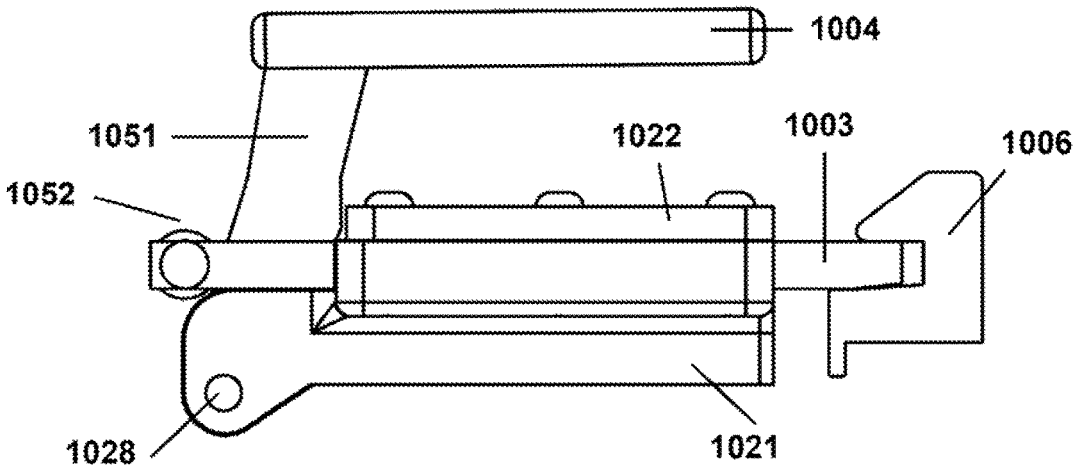
FIG. 13 is a side view of the latch shown in FIG. 10.
Figure 14:
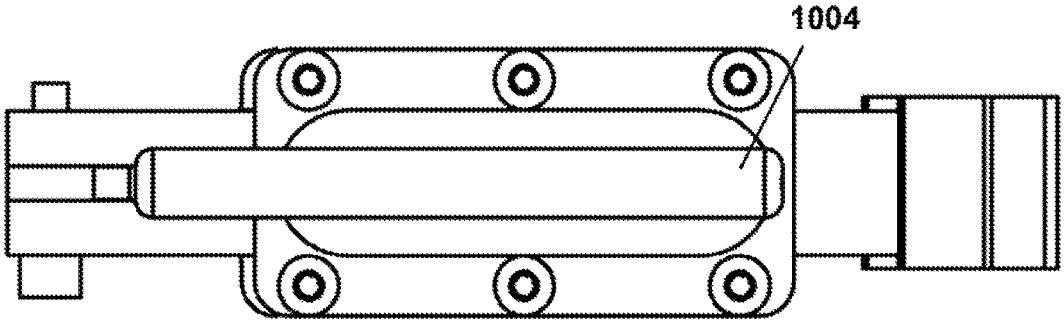
FIG. 14 is a plan view of the latch shown in FIG. 10.
Figure 15:
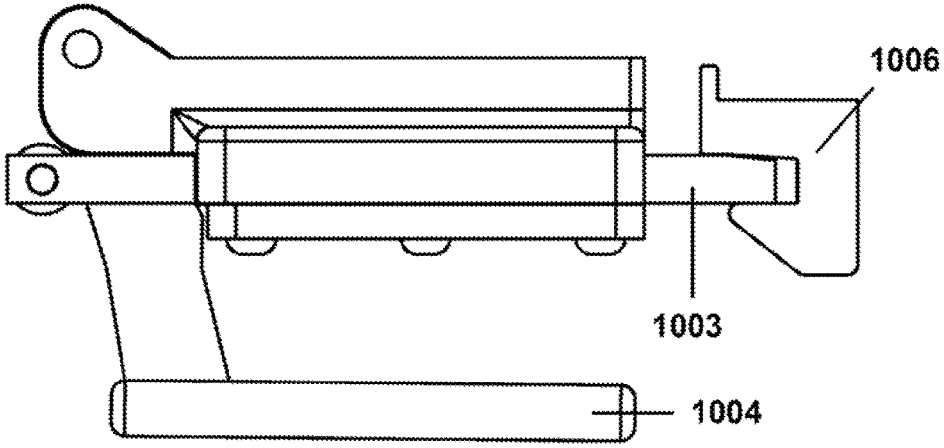
FIG. 15 is a further side view of the latch shown in FIG. 10.
Figure 16:
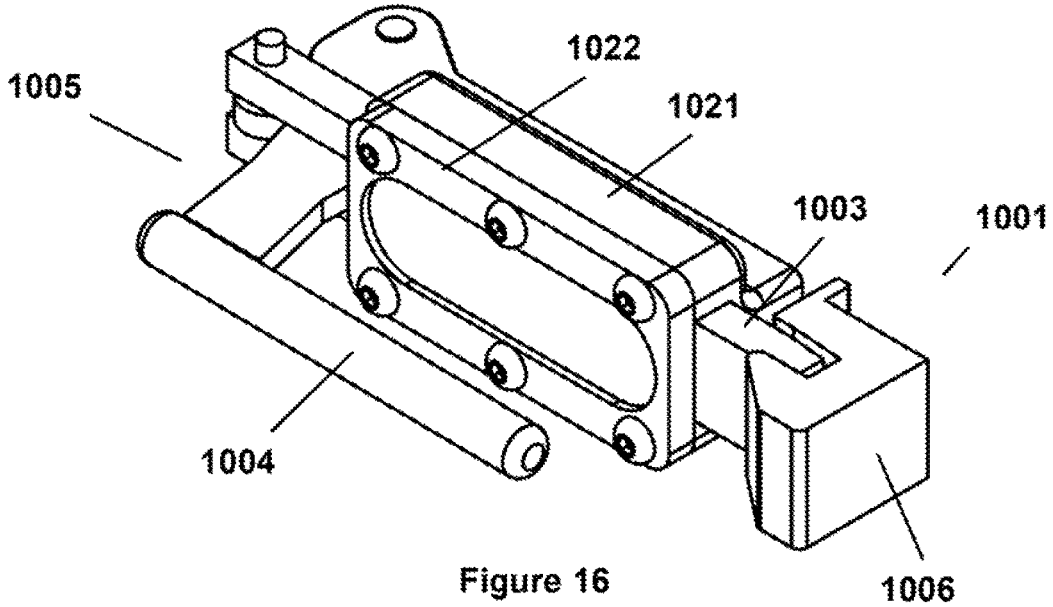
FIG. 16 is a further isometric view of the latch shown in FIG. 10.
Figure 17:
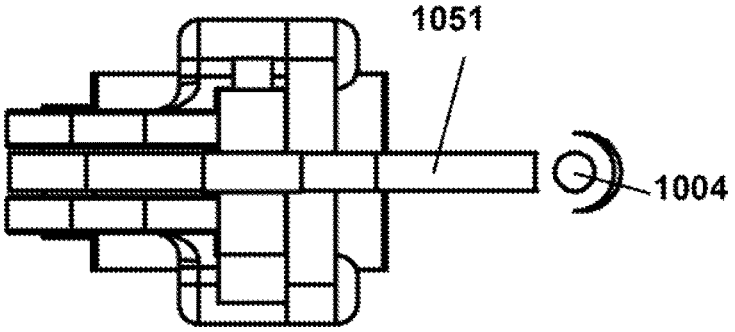
FIG. 17 is an end view (from the end opposite the keeper) of the latch shown in FIG. 10.
Figure 18:
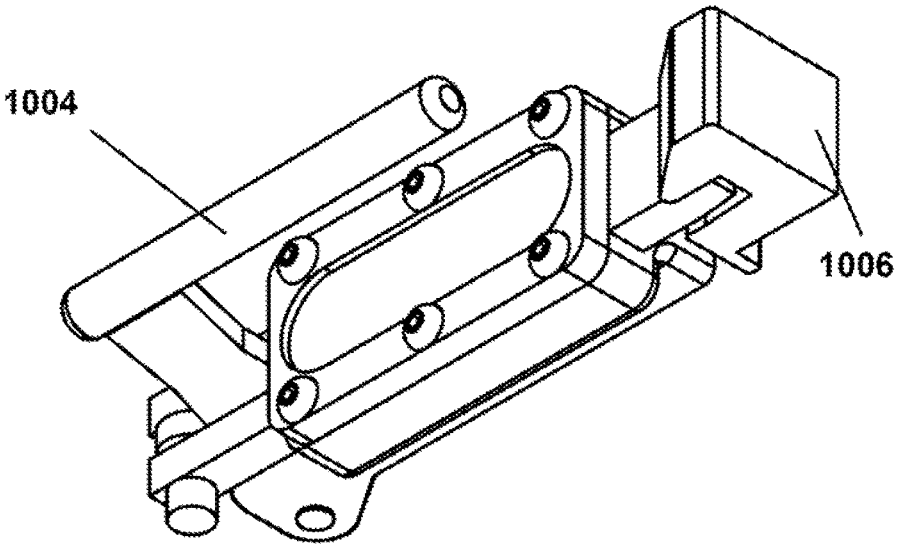
FIG. 18 is a further isometric view of the latch shown in FIG. 10.

The latch bolt 300 has a longitudinal axis and is made of steel. The latch bolt 300 is mounted to the mounting body 200 for axial movement relative to the mounting body 200 between a locking position (as shown in FIGS. 3, 5 and 6) and an unlocking position (as shown in FIGS. 7, 8 and 9). The latch bolt 300 comprises a cylindrical shaft region 330 and a keeper-engaging end 331 extending from the shaft region 330. The keeper-engaging end 331 has a chamfered/tapered edge 332 having an angle of about 4 to 8 degrees relative to the longitudinal axis and a length between about 3-12 mm (relative to the longitudinal axis).

The handle 400 is substantially L-shaped and is made of steel. One part 440 of the handle 400 extends substantially perpendicularly of the latch bolt 300 shaft region 330 and a free end 441 of the handle 400 extends substantially parallel with the longitudinal axis.

The latch bolt positioner 500 comprises a cam 550, a cam follower 551 and a biasing member 552, and the cam 550 and cam follower 551 are made of steel. The biasing member 552 is made of sprung steel.

The cam 550 is in the form of a collar extending around the shaft region 330 of the latch bolt 300 and affixed to the shaft region 330 of the latch bolt 300 by way of a fastener 354.

The handle 400, 440 is connected to the cam 550 by way of the shaft region 330 such that the cam 550 is rotated with the shaft region 330. The cam 550 is a truncated cylinder/cylindrical wedge which bears against the cam follower 551.

The cam follower 551 is in the form of a collar extending around the shaft region 330 and affixed to the upstanding end 221 of the mounting body 200 by way of a weld. Like the cam 550, the cam follower 551 is also a truncated cylinder/cylindrical wedge which bears against the cam 550.

The biasing member 552 is in the form of a coiled spring. The spring 552 is wound about the shaft region 330 of the latch bolt 300 between the upturned end 221 of the mounting bracket 200 and the cam 550. The spring 552 ensures that the cam 550 and cam follower 551 are always kept in contact with one another as well as that the latch bolt 300 may return to the locked position when the handle 400 is released by an operator.

When the handle 400 is used to rotate the shaft region 330 and the cam 550, the cam 550 and cam follower 551 are caused to axially separate and the keeper-engaging end 331 is moved to the unlocked position—against the force of the spring 552—as shown in FIGS. 7 and 8. When the handle 400 is released, the cam 550 rotates so as to return the latch bolt 300 to the locked position.

The keeper 600 has a steel body 660 providing a blind opening 661 for snugly receiving the keeper-engaging end 331 of the latch bolt 300. The keeper body 660 has a base 662 and a pair of spaced walls 663, 664 (first wall 664 and second wall 663) that extend from the base 662, all of which define the blind opening 661. The spaced walls 663, 664 have inner faces that converge/extend towards one another as they near the base 662 so as to provide a snug fit for the keeper-retaining end 331. One of the walls 663 (the front wall, leading wall or second wall) has a sloping or ramped outer surface 665 along which the keeper-engaging end 331 slides when on its way to the blind opening 661 in the keeper 600. The other wall 664 (the rear wall, trailing wall or first wall) is approximately 4 mm longer than wall 663.

The base 662 has openings (not shown) through which fasteners extend to mount the base 662 to a non-moving fixture such as a post, jamb, framework or other structure.

In use, the mounting body 200 is mounted to a hinged gate (or other type of movable panel) and the keeper 600 is mounted to a non-moving fixture such as a gate post, jamb, framework or other structure.

When the hinged gate is swung towards the keeper 600, the latch bolt 300 rides along and up over the sloping or ramped outer surface 665 of the keeper 600, and the spring 552 ensures that the keeper-retaining end 331 of the latch bolt 300 engages the opening 661 so as to lock the hinged gate to the gate post. In order to unlock the hinged gate, the handle 400 is rotated by an operator such that the cam 550 and cam follower 551 are axially separated, and the keeper-engaging end 331 disengages the keeper 600. When the handle 400 is released, the spring 552 ensures that the latch bolt 300 is again extended to the locking position. As illustrated at "C" in FIG. 9, the capacity of cam 550 and cam follower 551 to open is greater than the total depth of 661.

Referring to FIGS. 10 to 27, there is provided two examples of a slam latch 1001. Although these example slam latches are particularly suited for securing doors and swinging panels (for example), especially in agricultural applications (e.g. for handling livestock such as sheep, pigs, horses or cattle), they may have other non-agricultural commercial uses.

The slam latch 1001 comprises a mounting body 1002, a latch bolt 1003, a handle, 1004, a latch bolt positioner 1005 and a keeper 1006.

Figure 19:
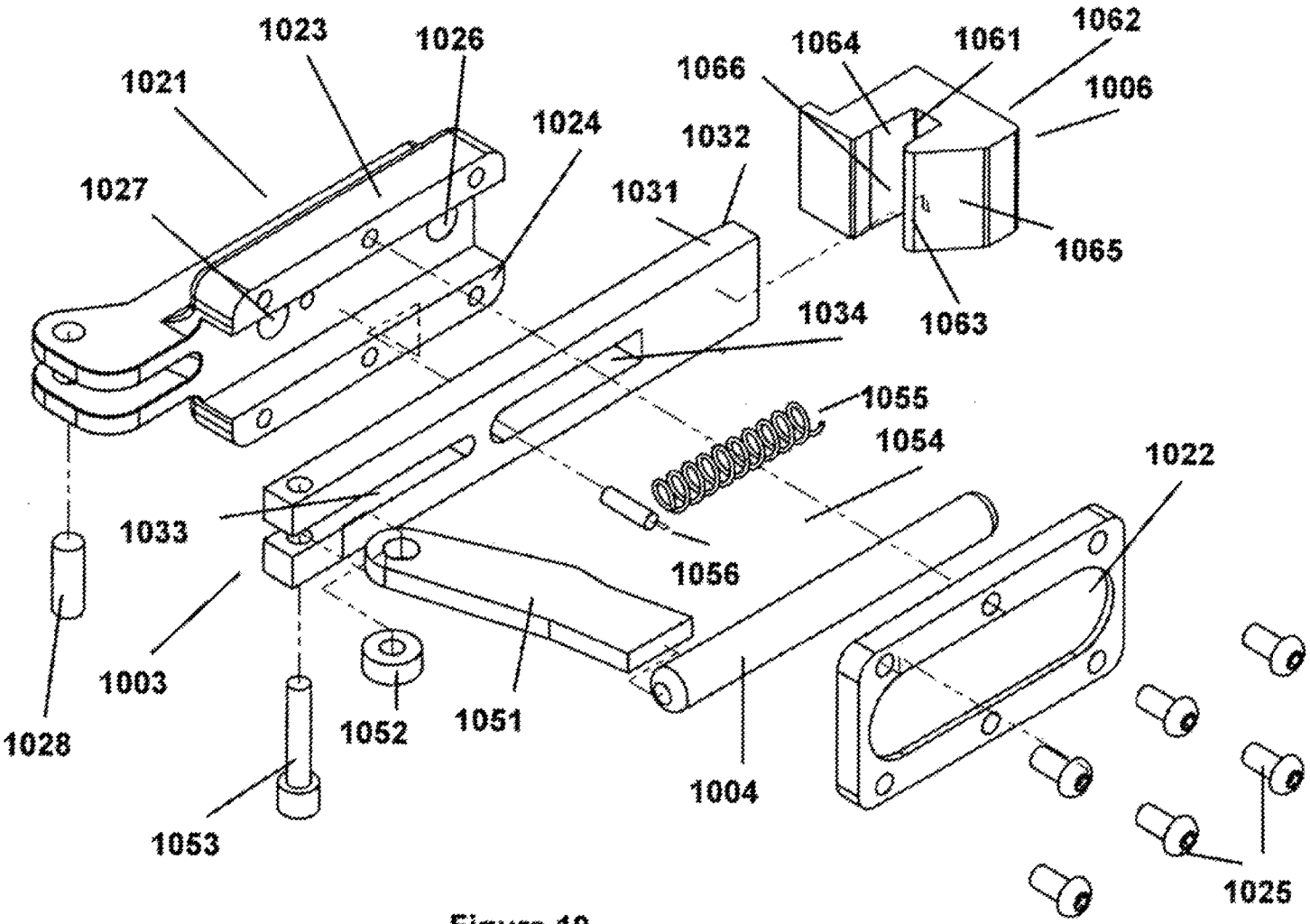
FIG. 19 is an exploded isometric view of the latch shown in FIG. 10.
Figure 20:
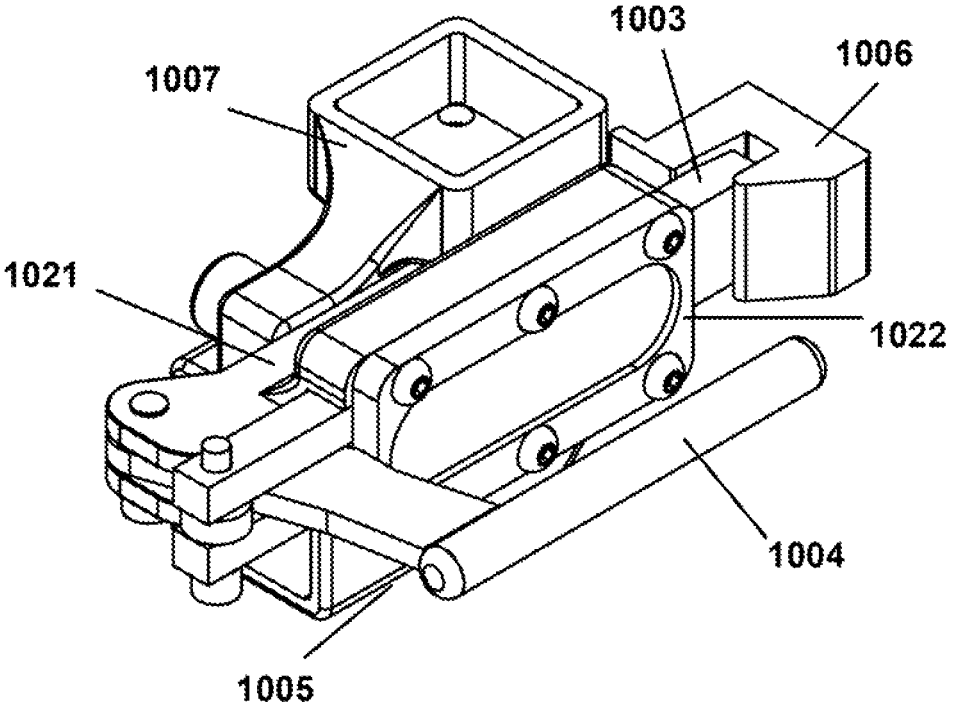
FIG. 20 is an isometric view of the latch shown in FIG. 10, when mounted to a support.
Figure 21:
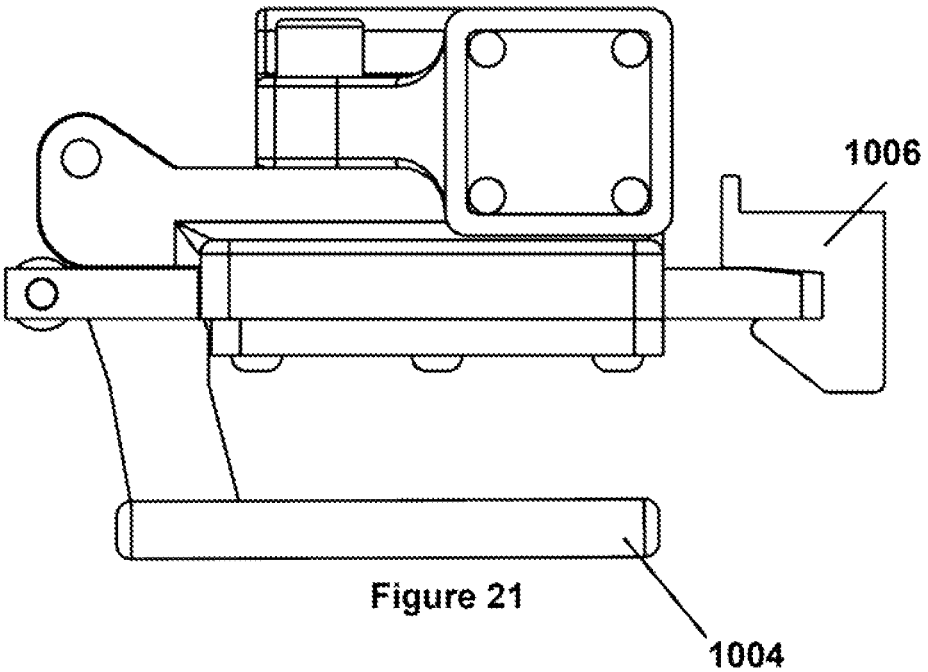
FIG. 21 is a plan view of the latch shown in FIG. 20, when the latch is in the locking position.
Figure 26:
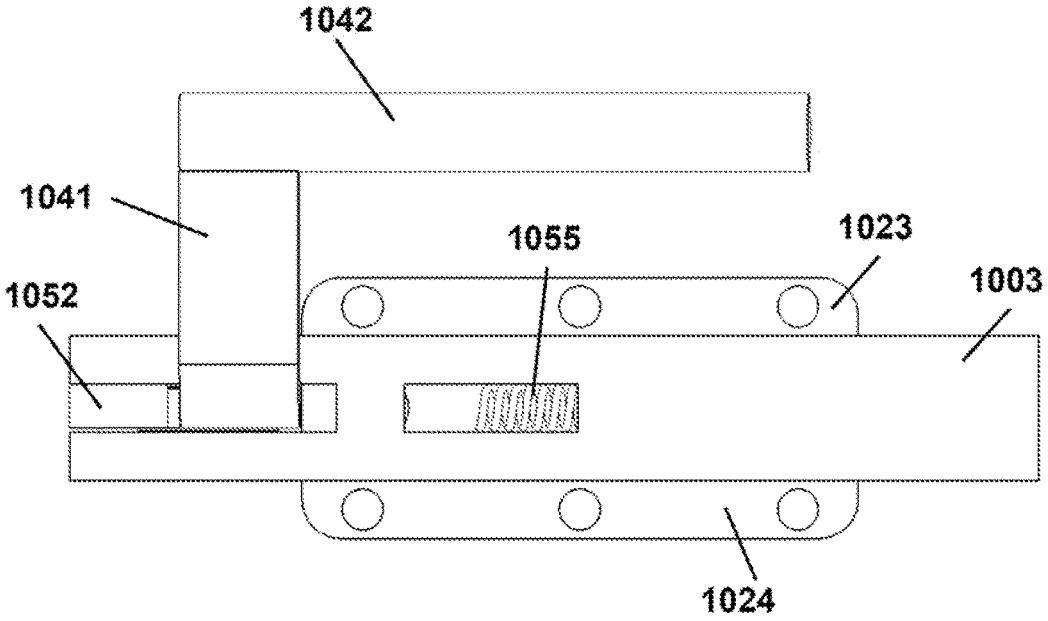
FIG. 26 is a plan view of the latch shown in FIG. 25, except illustrating the latch with the mounting cover removed.
Figure 27:
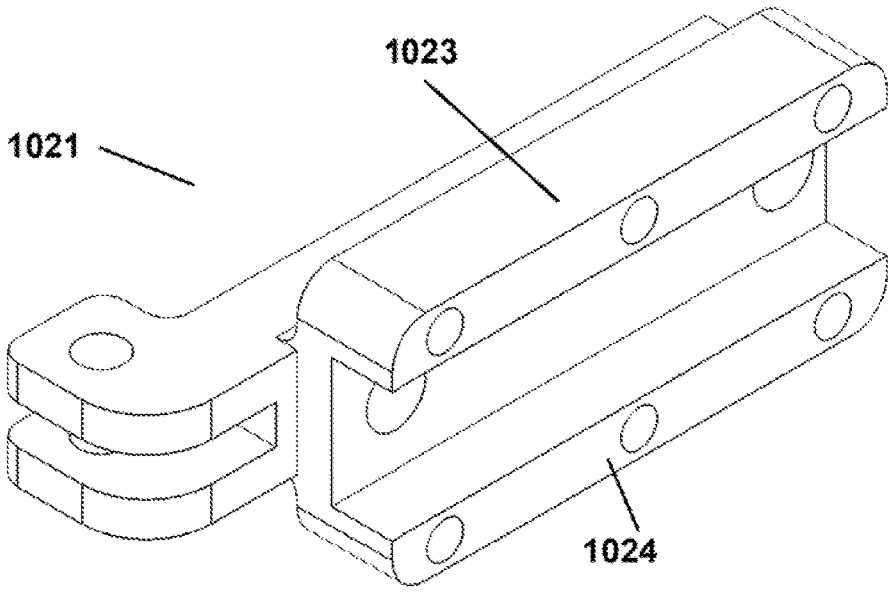
FIG. 27 is an isometric view of the mounting support of the example of FIG. 23.
Figure 28:
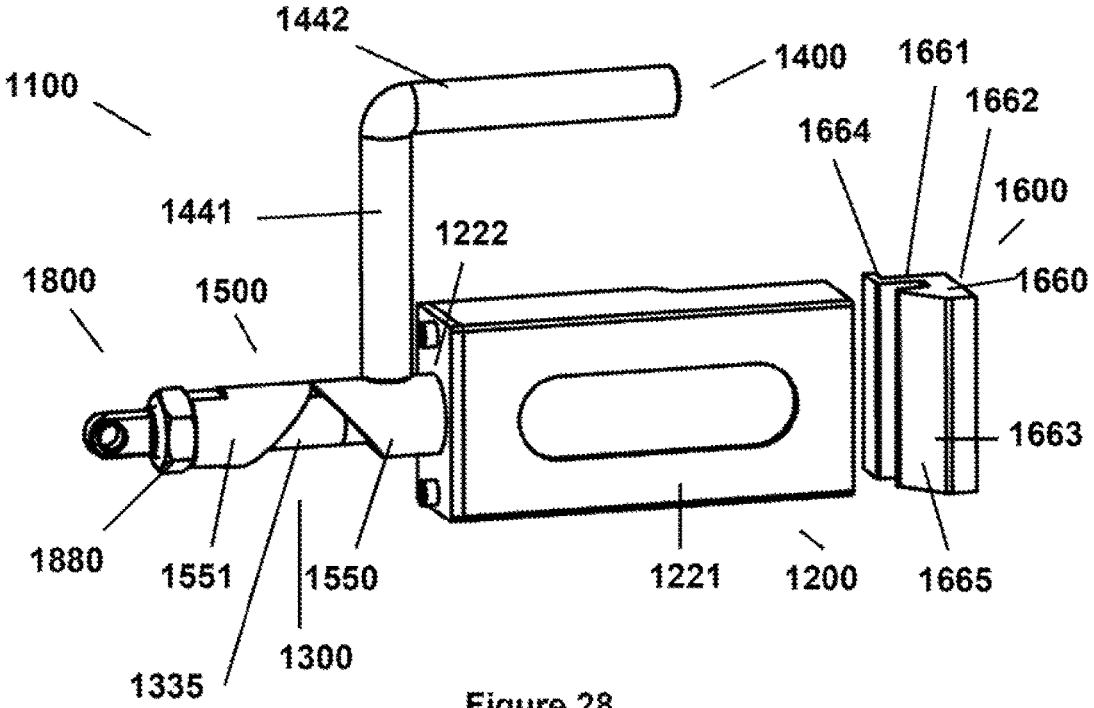
FIG. 28 is an isometric view of a latch shown having a latch bolt in an unlocking position, according to a fifth example of the present invention.
Figure 29:
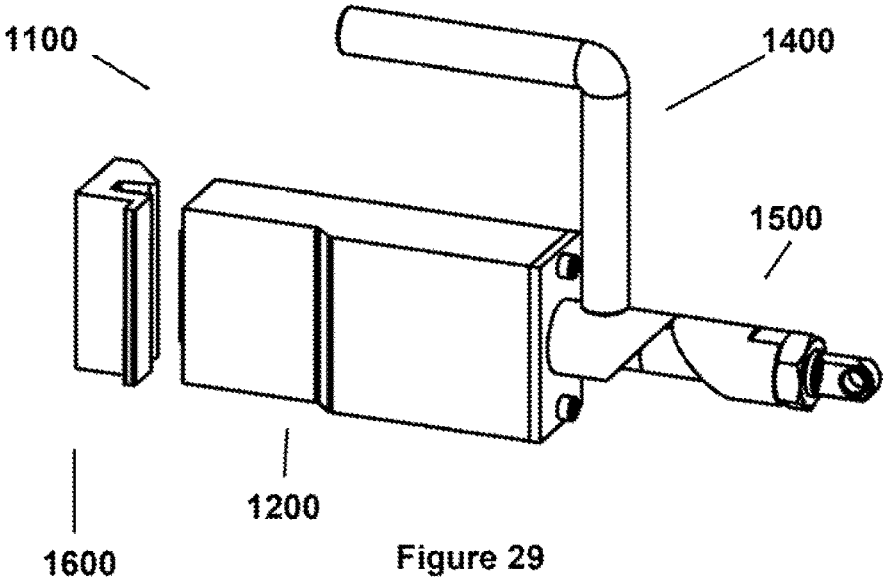
FIG. 29 is a further isometric view of the latch shown in FIG. 28.
Figure 30:
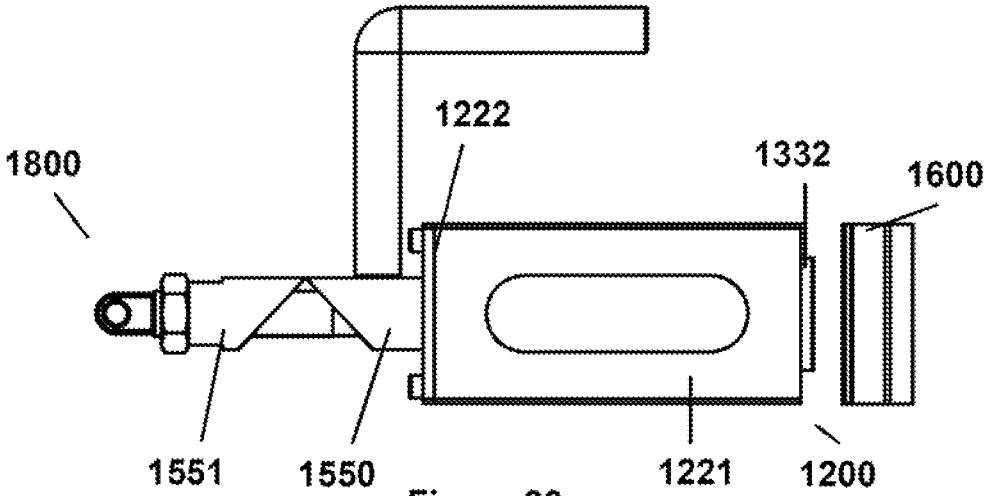
FIG. 30 is a plan view of the latch shown in FIG. 28.
Figure 31:
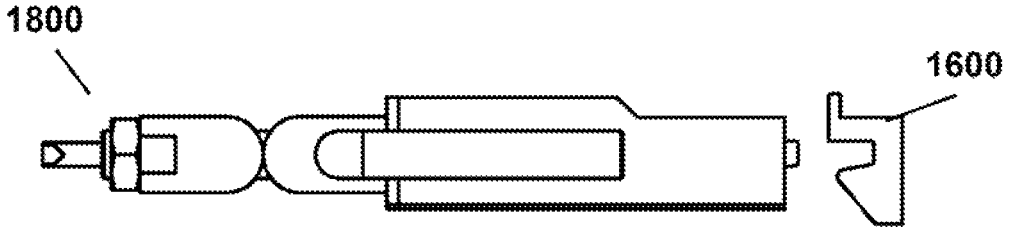
FIG. 31 is a side view of the latch shown in FIG. 28.
Figure 32:
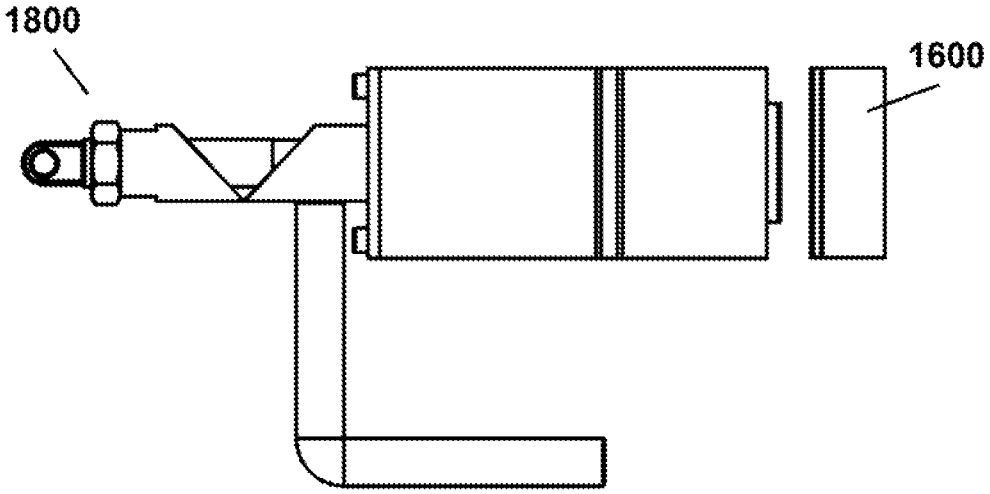
FIG. 32 is a further plan view of the latch shown in FIG. 28.
Figure 33:
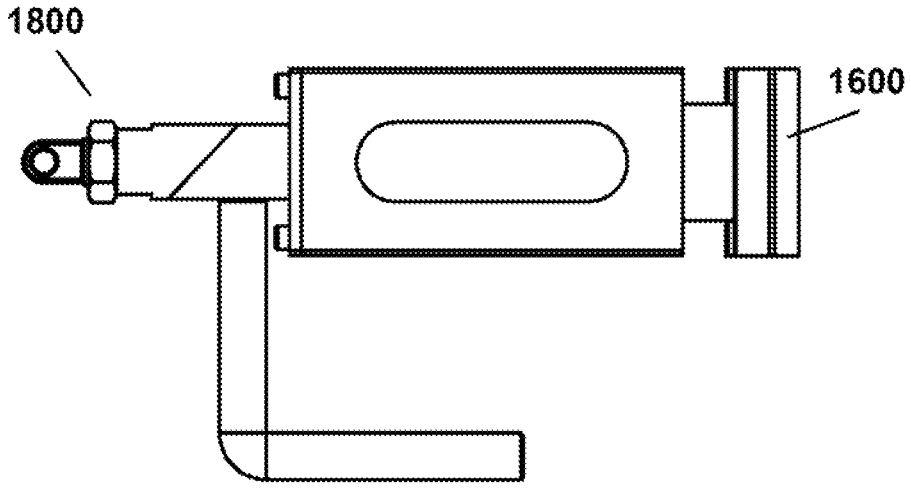
FIG. 33 is a plan view of the latch shown in FIG. 28, with the latch bolt in a locking position.
Figure 34:
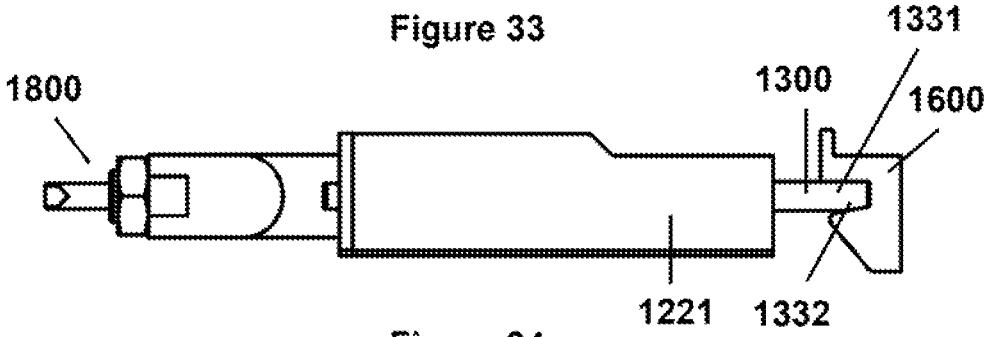
FIG. 34 is a side view of the latch shown in FIG. 33.
Figure 35:
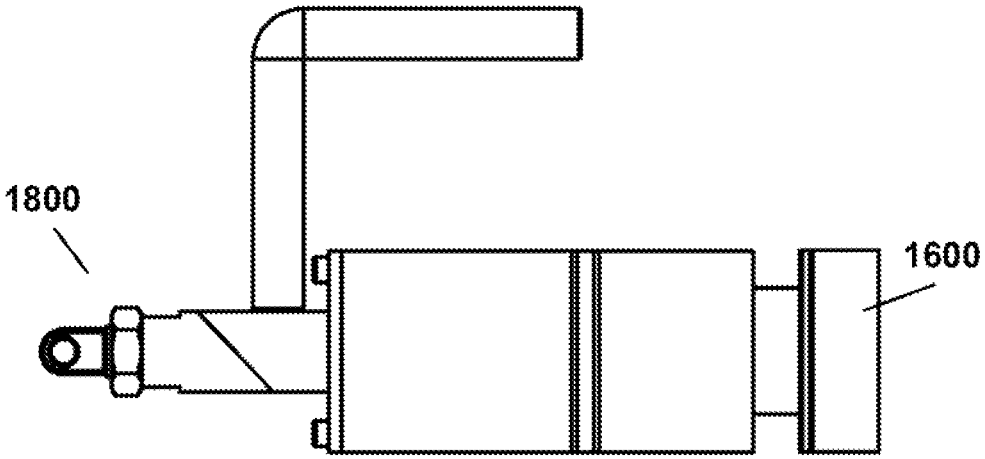
FIG. 35 is a further plan view of the latch shown in FIG. 33.

The mounting body 1002 comprises a mounting support 1021 and a mounting cover 1022. As seen in FIGS. 19, 26 and 27, the sides 1023, 1024 of the mounting support project to define a channel/passageway for accommodating a cuboid latch bolt 1003. As seen in FIG. 19, the cover 1022 may be fastened to the mounting support 1021 by way of fasteners (screws) 1025. When the mounting cover 1022 is fastened to the mounting support 1021, a channel/passageway is defined within which the bolt 1003 is held in a single plane. The mounting support 1021 has openings 1026, 1027 (see FIG. 19) through which fasteners (screws) extend to mount the mounting support 1021 to a gate (for example). In the embodiments illustrated in FIGS. 20-22 the slam latch 1001 is shown mounted to a part of a post assembly 1007.

Referring now to FIG. 19, the latch bolt 1003 has a longitudinal axis and is made of steel. The latch bolt is accommodated within the passageway/channel formed by the mounting support 1021 and the mounting cover 1022. The latch bolt 1003 is of cuboid overall shape, and it includes a number of cut-outs/slots. The latch bolt illustrated in these examples is "A" shaped, wherein the apex of the "A" is the keeper-engaging region 1031.

The keeper-engaging region 1031 in these examples has a taper on one side 1032 (keeper-engaging region first side), which has an angle of about 4 to 8 degrees relative to the longitudinal axis and a length between about 3-12 mm (relative to the longitudinal axis). The opposite side of the keeper engaging region 1031 (the keeper-engaging region second side) is planar and includes no taper.

As seen in FIG. 19, the latch bolt positioner 1005 comprises a latch bolt actuator 1051 (cam) pivotally mounted to the mounting support 1021 by way of a pivot bolt 1028. When assembled, the latch bolt actuator 1051 extends through a slot (cut-out) 1033 in the latch bolt. The latch bolt positioner 1005 further comprises a cam follower (roller) 1052 and a fastener (bolt) 1053. The cam follower 1052 is mounted on the bolt 1053. As the latch bolt actuator 1051 is moved away from the keeper-engaging region 1031 of the bolt, a cam-surface of the actuator 1051 bears against the cam follower 1052 so as to move the latch bolt to the unlocking position. The cam follower 1052 is preferably made of nylon (which provides noise reduction compared to, for example, a steel cam follower).

The latch bolt 1003 further comprises a slot 1034 for housing a biasing mechanism 1054, which comprises a helical spring 1055 and stop pin 1056. One end of the spring 1055 bears against the stop pin 1056, and the other bears against the side of the slot 1034. Actuation of the latch bolt actuator 1051 results in movement of the latch bolt 1003 into the unlocking position and compression of spring 1055, biasing the latch bolt 1003 to return to the locking position.

The handle 1004 in the example illustrated in FIGS. 10-22 is substantially linear, and is connected to the latch bolt actuator 1051. In the example illustrated in FIGS. 23-27 the handle is substantially L-shaped, including parts 1041 and 1042.

The keeper 1006 has a steel body 1060 providing a blind opening 1061 for snugly receiving the keeper-engaging region 1031 of the latch bolt. The keeper body 1060 has a base 1062 and a pair of spaced walls 1063, 1064 that extend from the base 1062, all of which define the blind opening 1061 (and rear end of the walls). The spaced walls 1063 and 1064 (first wall 1064 and second wall 1063) together define a mouth of the opening 1066. The spaced wall 1064 extends towards wall 1063 as it nears the base 1062 so as to provide a snug fit for the keeper-retaining region 1031. One of the walls 1063 (i.e. the front wall, leading wall or second wall) has a sloping or ramped outer surface 1065 along which the keeper-engaging end 31 slides when on its way to the blind opening 1061 in the keeper 1006. The other wall 1064 (i.e. the rear wall, trailing wall or first wall) is approximately 4 mm longer than wall 1063.

The base 1062 has openings (not shown) through which fasteners extend to mount the base 1062 to a fixture such as a post, jamb, framework or other structure.

In use, the mounting body 1002 is mounted to a hinged gate (or other type of movable panel) and the keeper 1006 is mounted to a non-moving fixture such as a gate post, jamb, framework or other structure.

Figure 22:
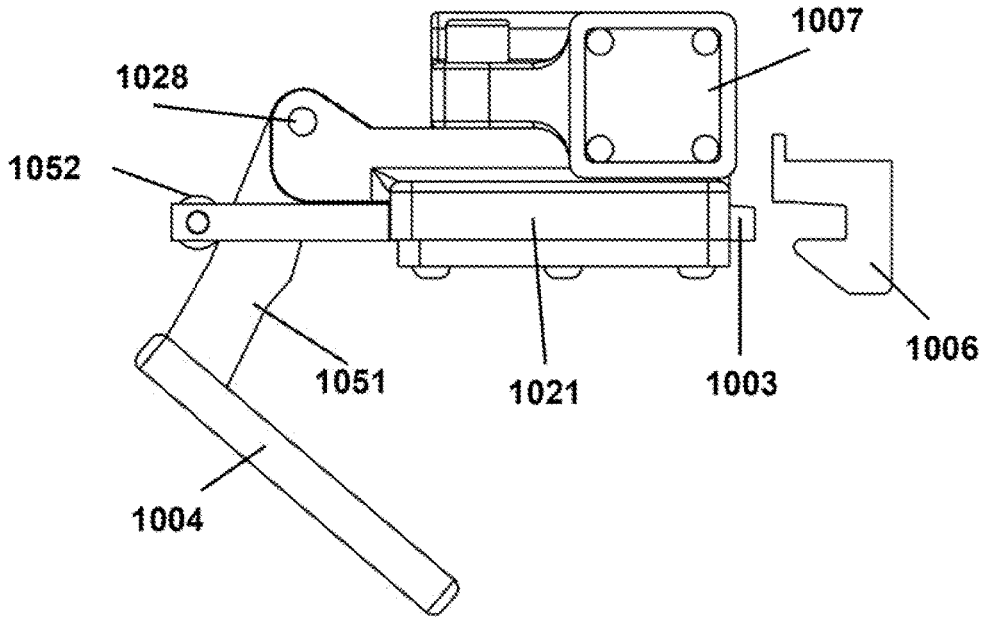
FIG. 22 is a plan view of the latch shown in FIG. 20, when the latch is in the unlocking position.
Figure 23:
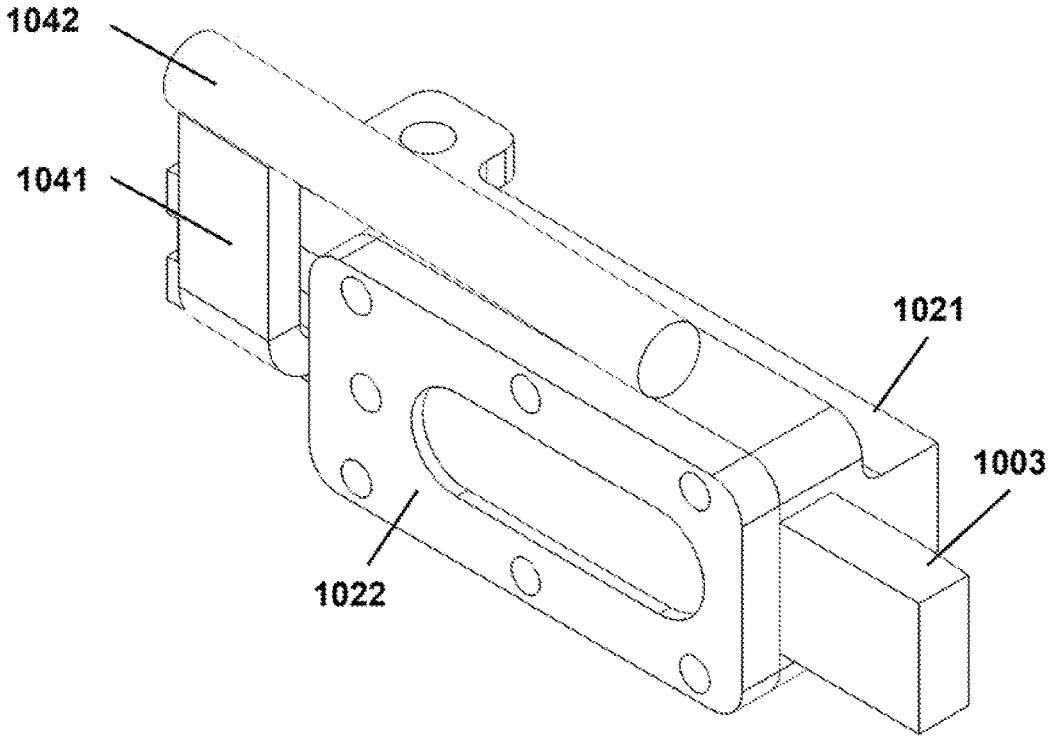
FIG. 23 is an isometric view of a latch shown having a latch bolt in a locking position, according to a fourth example of the present invention.
Figure 24:
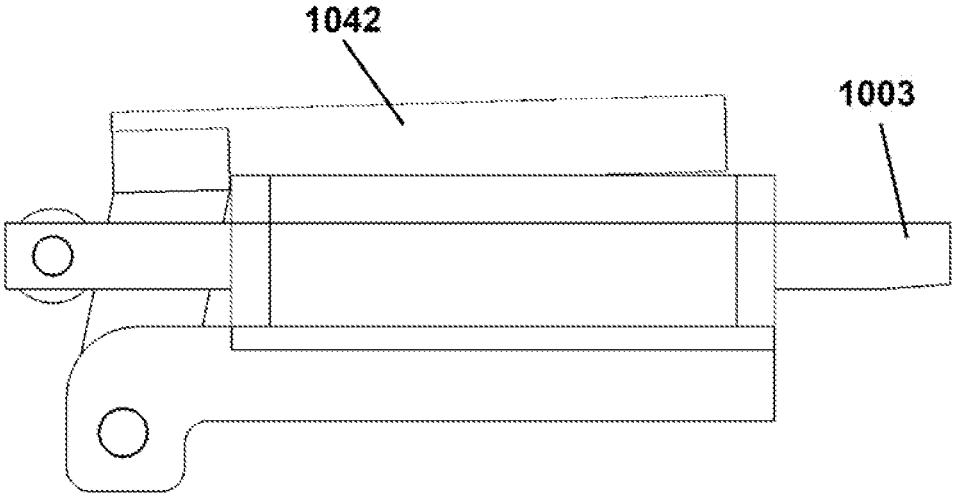
FIG. 24 is a side view of the latch shown in FIG. 23.
Figure 25:
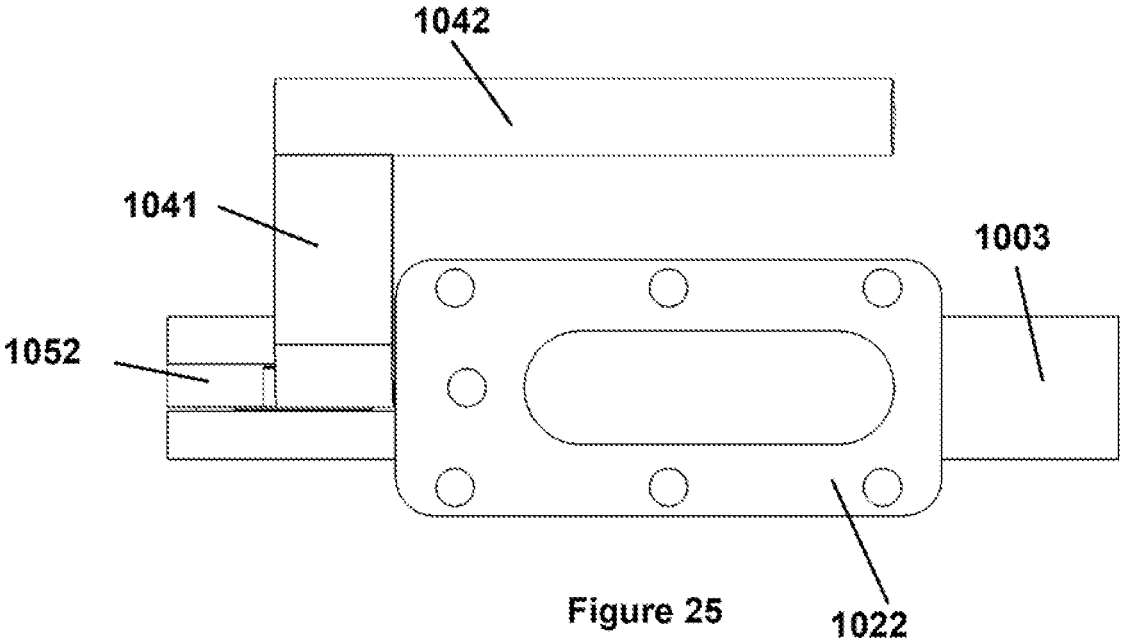
FIG. 25 is a plan view of the latch shown in FIG. 23.

When the hinged gate is swung towards the keeper 1006, the latch bolt 1003 rides along and up over the sloping or ramped outer surface 1065 of the keeper 1006, and the spring 1055 ensures that the keeper-engaging region 1031 of the latch bolt 1003 engages the opening 1061 so as to lock the hinged gate to the gate post. In order to unlock the hinged gate, the handle 1004 is levered by an operator away from the mounting body 1002, such that (cam) latch bolt actuator 1051 moves against cam follower 1052 so as to move the latch bolt 1003 into the unlocking position (this is illustrated in FIG. 22). When the handle 1004 is released, the spring 1055 ensures that the latch bolt 1003 is again extended to the locking position.

FIGS. 28-35 illustrate a further example slam latch for locking a hinged gate (not shown) to a gate post (not shown), for example.

Although the slam latch as described herein is particularly suited for securing doors and swinging panels, particularly in agricultural applications (e.g. for handling livestock such as sheep, pigs or cattle), it may have other non-agricultural commercial uses.

The slam latch 1100 comprises a mounting body 1200, a latch bolt 1300, a handle 1400, a latch bolt positioner 1500 and a keeper 1600.

The mounting body 1200 comprises a mounting support 1221 and a mounting cover 1222. The mounting support 1221 defines a passageway/channel for accommodating a latch bolt 1300, which is of cuboid shape. In this example, the passageway is machined out of a solid piece of metal.

This arrangement allows the mounting support 1221 to hold the latch bolt 1300 in a single plane, leading to a more robust and sturdy latch. The mounting support 1221 has openings (not shown) through which fasteners (screws) extend to mount the mounting plate 20 to a hinged gate.

The latch bolt 1300 has a longitudinal axis and is made of steel. The latch bolt 1300 is accommodated within the mounting support 1221 for axial movement relative to the mounting body 1200 between a locking position (see FIGS. 33 to 35) and an unlocking position (as shown in FIGS. 28 to 32). The latch bolt 1300 comprises a cylindrical shaft region 1335 and a keeper-engaging end 1331 extending from the shaft region 1335. The keeper-engaging end 1331 is in the form of a plate and has a chamfered/tapered edge 1332 having an angle of about 4 to 8 degrees relative to the longitudinal axis and a length between about 3-12 mm (relative to the longitudinal axis).

The handle 1400 is substantially L-shaped and is made of steel. One part 1441 of the handle 1400 extends substantially perpendicularly of the latch bolt 1300 shaft region 1335 and a free end 1442 of the handle 1400 extends substantially parallel with the longitudinal axis.

The latch bolt positioner 1500 comprises a cam 1550, a cam follower 1551 and a biasing member (not shown—the biasing member is inside the mounting support 1221 in a similar arrangement to that shown in FIGS. 10-26), and the cam 1550 and cam follower 1551 are made of steel. The biasing member is made of sprung steel. The biasing member is a spring that ensures that the cam 1550 and cam follower 1551 are always kept in contact with one another as well as that the latch bolt 1300 may return to the locking position when the handle is released by an operator.

The cam 1550 is in the form of a collar extending around the shaft region 1335 of the latch bolt, and the handle 1400 is connected to the cam 1550 such that the cam 1550 may be rotated about the shaft region 1335 (longitudinal axis). The cam 1550 is a truncated cylinder/cylindrical wedge which bears against the cam follower 1551.

The cam follower 1551 is in the form of a collar extending around and affixed to the shaft region 1335 of the latch bolt. Like the cam 1550, the cam follower 1551 is also a truncated cylinder/cylindrical wedge which bears against the cam 1550.

When the handle 1400 is used to rotate the cam 1550 about the shaft region 1335 of the latch bolt 1300, the cam 1550 and cam follower 1551 are caused to axially separate and the keeper-engaging end 1331 is moved to the unlocked position—against the force of the biasing member—as shown in FIGS. 28 to 32. When the handle 1400 is released, the cam 1550 rotates so as to return the latch bolt 1300 to the locked position.

The slam latch also includes a latch bolt adjuster 1800 for adjusting the throw of the bolt. As shown in FIGS. 28 to 35 the latch bolt adjuster 1800 comprises a nut 1880 which is positioned on a threaded end of the shaft region 1335 of the latch bolt 1300. Alternatively, the adjuster 1800 may comprise both the nut 1880 and thread. Turning the nut further onto the bolt reduces the throw, and turning the nut off the bolt increases the throw. Movement of the latch bolt adjuster 1800 may also advantageously adjust the tension of the biasing member, and may also alter the tolerances between the cam 1550 and cam follower 1551 to improve operation of the latch.

The keeper 1600 has a steel body 1660 providing a blind opening 1661 for snugly receiving the keeper-engaging end 1331 of the latch bolt. The keeper body 1660 has a base 1662 and a pair of spaced walls 1663, 1664 that extend from the base 1662, all of which define the blind opening 1661. The spaced walls 1663, 1664 have inner faces that converge/extend towards one another as they near the base 1662 so as to provide a snug fit for the keeper-retaining end 1331. One of the walls 1663 (i.e. the front wall, leading wall or second wall) has a sloping or ramped outer surface 1665 along which the keeper-engaging end 1331 slides when on its way to the blind opening 1661 in the keeper 1600. The other wall 1664 (i.e. the rear wall, trailing wall or first wall) is approximately 4 mm longer than wall 1663.

The base 1662 has openings (not shown) through which fasteners extend to mount the base 1662 to a non-moving fixture such as a post, jamb, framework or other structure.

In use, the mounting body 1200 is mounted to a hinged panel (or other type of movable door or gate) and the keeper 1600 is mounted to a non-moving fixture such as a gate post, jamb, framework or other structure. However, the reverse arrangement may also be used, such as when the mounting body is mounted to a non-moving fixture and the keeper 1600 is mounted to a moving fixture.

When the hinged panel is swung towards the keeper 1600, the latch bolt 1300 rides along and up over the sloping or ramped outer surface 1665 of the keeper 1600, and the biasing member ensures that the keeper-retaining end 1331 of the latch bolt 1300 engages the opening 1661 so as to lock the hinged panel to the non-moving fixture. In order to unlock the hinged panel, the handle 1400 is rotated by an operator such that the cam 1550 and cam follower 1551 are axially separated, and the keeper-engaging end 1331 disengages the keeper 1600. When the handle 1400 is released, the biasing member ensures that the latch bolt 1300 is again extended to the locking position.

The slam latch as exemplified is particularly suited for use in agriculture, such as for securing doors and swinging panels when constraining and limiting the movement of animals (especially livestock) in pens, yards and enclosed spaces such as cattle crushes.

Figure 36:
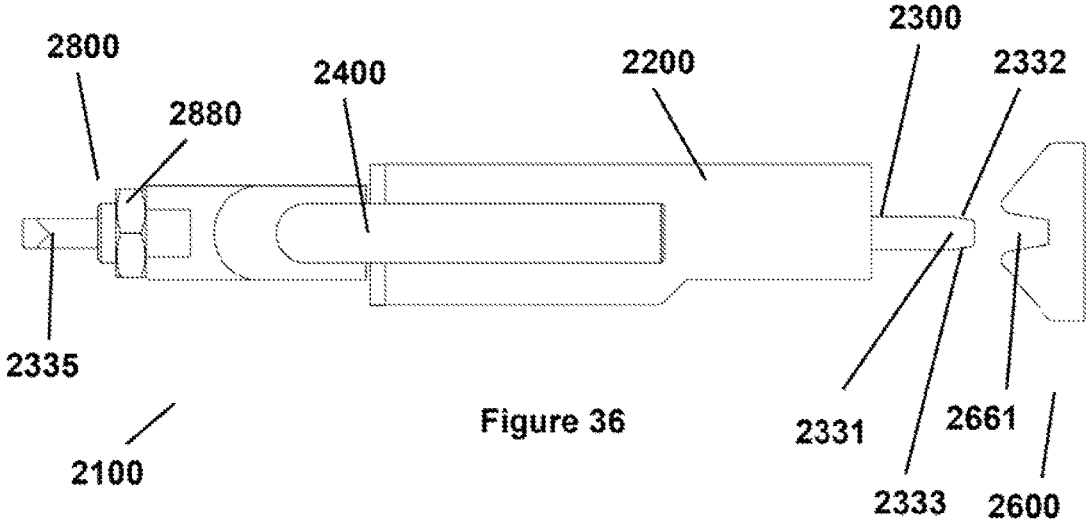
FIG. 36 is a side view of a sixth example latch of the present invention.
Figure 37:
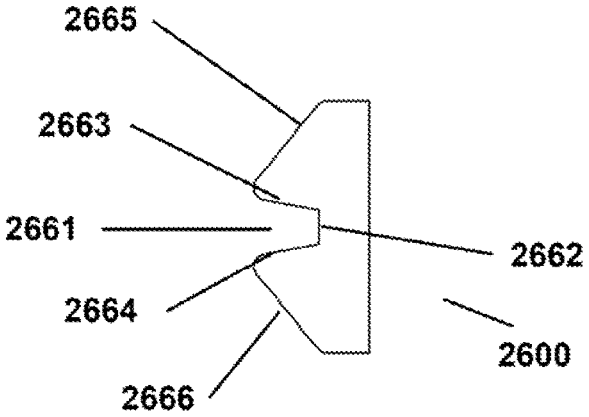
FIG. 37 is a side view of the keeper of the latch shown in FIG. 36.

FIGS. 36 and 37 illustrates a latch suited for use in non agricultural applications where swinging panels or doors are required to be opened in one or two directions, but at times the panel or door is secured to provide a strong and secure rattle free, noise free engagement.

The latch 2100 comprises a mounting body 2200, a latch bolt 2300, a handle 2400, a latch bolt positioner (not shown) and a keeper 2600.

The mounting body 2200, latch bolt 2300, handle 2400 and latch bolt positioner are similar to those illustrated in FIGS. 28-35.

The latch bolt 2300 comprises a keeper-engaging region 2331 in the form of a plate which has a first side 2332 and a second side 2333, which are both chamfered/tapered edges having an angle of about 4 to 8 degrees relative to the longitudinal axis and a length between about 3-12 mm (relative to the longitudinal axis). The latch bolt 2300 also comprises a shaft region 2335 which is connected to the keeper engaging region 2331.

The handle 2400 is substantially L-shaped and is made of steel. One part of the handle 2400 is connected to the latch bolt 2300. The latch bolt positioner comprises a biasing member which ensures that the latch bolt 2300 is pressed into the keeper 2600.

The latch also includes a latch bolt adjuster 2800 for adjusting the throw of the bolt. The latch bolt adjuster 2800 comprises a nut 2880 which is positioned on a threaded end of the shaft region 2335 of the latch bolt 2300. Alternatively, the adjuster 2800 may comprise both the nut 2880 and thread. Turning the nut further onto the bolt reduces the throw, and turning the nut off the bolt increases the throw. Movement of the latch bolt adjuster 2800 may also advantageously improve operation of the latch.

The keeper 2600 (see FIG. 37) has a steel body providing a blind opening 2661 for snugly receiving the keeper-engaging end 2331 of the latch bolt. The keeper has a base 2662 and a pair of spaced walls 2663, 2664 that extend from the base 2662, all of which define the blind opening 2661. The spaced walls 2663, 2664 have inner faces that converge/extend towards one another as they near the base 2662 so as to provide a snug fit for the keeper-retaining end 2331. Both of the walls 2663, 2664 have a sloping or ramped outer surface 2665, 2666 along which the keeper-engaging region 2331 slides when on its way to the blind opening 2661 in the keeper 2600.

The latch illustrated in FIGS. 36 and 37 may also be configured so that the keeper has no sloping or ramped outer surface 2665, 2666. Also, the latch bolt positioner may be configured so that the latch bolt does not automatically return to the locking position. The latch 2100 may also be configured to include a locking mechanism. The latch 2100 may also be altered to accommodate different types of handles 2400, or more than one handle 2400.

The latch as exemplified provides means for preventing a latch bolt from rattling against its associated receiving keeper when in the locking position. The latch as exemplified provides means to ensure the tight engagement of a door with its associated stop/keeper. The latch as exemplified (in FIGS. 1-35) also provides means to prevent the latch bolt travelling past the designated stop position. The latch as exemplified further provides means for obviating the necessity of accurately positioning a latch strike with respect to a door stop and yet retaining the desirable characteristics of accurate and careful installation of a door latch assembly.

The inventors have found that having large chamfered ends/angles on round keeper-engaging ends of latch bolts increase the potential for such ends to disengage their keepers when subjected to excessive side force. The inventors have further found that having too little an angle (i.e. 3 degrees or smaller) results in the end actually wanting to "seize" (or lock) in a mating taper of the keeper (i.e. morse-type tapers). The inventors have discovered that the optimal angle, on either the round ends (as per FIGS. 3-7) or the flat keeper-engaging ends (as per FIGS. 1 and 2), is usually anywhere between 4 degrees and 15 degrees (or even up to 20 degrees), so as to provide an optimal locking result.

The inventors have found that known slam latches have a small chamfer, perhaps 1.5-3 mm in length as measured from the end of the latch bolt along its axis, and this is to remove any sharp edge so as to limit the scraping of a sharp edge against the keeper/striker plate surface and assist the latch bolt to slide up on the keeper/striker plate and also assist in the engagement process—by helping the round latch bolt to begin to enter into the opening in the keeper/striker plate as early as possible. However, if the chamfer is too big the door may swing past the opening and fail to engage. This is due to the speed of the door and the size/length of the chamfered edge—normally at 45 degrees, maximum 3 mm in length. If the chamfer is too big it will allow the leading edge of the latch bolt to begin to engage in the keeping region earlier but before the outside surface of the latch bolt diameter may propel outwards past the square edge of the keeper/striker plate opening so as to secure the latch bolt and halt the momentum—the chamfer may begin to make contact with the back edge (i.e. rear wall, trailing wall or first wall) of the keeper/striker plate and actually begin to ride up over the back edge (i.e. rear wall, trailing wall, first wall) of the opening forcing the latch bolt open again—due to the momentum and speed and 45 degree angle and depth of the chamfer.

The present invention as exemplified in one or more examples on the other hand has a much longer chamfer (typically more than 3 mm and preferably 8-10 mm) and also a reduced angle (typically 4-15 degrees) to increase the positive engagement and reduce the risk of the latch bolt "riding up" the back edge (i.e. rear wall, trailing wall or first wall).

In addition, in one embodiment the back edge (rear wall, trailing wall or first wall) of the keeper/striker of the present invention is not on the same plane as the front edge (front or leading wall). The back edge (rear wall/trailing wall) may project out an extra 4 mm or so which increases positive engagement of the latch bolt with the opening. As the latch bolt strikes the front edge (front or leading wall) of the keeper/striker plate it causes the latch bolt to compress to a maximum of say 20 mm. As the door continues to close there is no other force or action to cause the latch bolt to retract any further than the planar surface of the striker plate/keeper, so if for some reason the latch bolt does not engage and begins to move pass true axial alignment with the opening the latch bolt strikes the back edge (rear wall/trailing wall) of the opening which protrudes an additional 4 mm. This extension, in effect, creates a 'mini stop'. However there is sufficient capacity of the handle to open the latch bolt this extra 4 mm if operated manually, in the case where the operator wants to open the door past the keeper engaging region (which may be the case in crush applications or general gates as well which operate in predominantly one direction).

In addition, the keeper-engaging end of the latch bolt does not come into contact with the base of the keeper body or fixture to which the keeper body is mounted because the latch bolt is spring-loaded/biased and the spring/biasing member ensures that the latch bolt continues to move outwards until it is wedged between the inner mating faces of the walls thereby ensuring zero gap. This in turn results in no lateral movement of the latch bolt when in the keeper, minimising rattle and improving the robustness of the latch, even when a large load is applied to a swinging panel or door (for example by an animal). The inventors have found this feature to be an important difference and advantage over known slam latches.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Although the disclosed subject matter has been described and illustrated in the foregoing illustrative implementations, it is understood that the present disclosure has been made only by way of example, and that numerous changes in the details of implementation of the disclosed subject matter can be made without departing from the spirit and scope of the disclosed subject matter, which is limited only by the claims that follow. Features of the disclosed implementations can be combined and rearranged in various ways.

What is claimed is:

1. A latch for a swinging door or swinging panel, the latch comprising:

a mounting body;

a latch bolt in slideable engagement with the mounting body for movement relative to the mounting body between a locking position and an unlocking position, said latch bolt having a keeper-engaging region extending from the mounting body and terminating at a keeper-engaging end;

a latch bolt positioner comprising a biasing mechanism to bias the latch bolt to the locking position; and a keeper having at least a trailing wall and a leading wall which are spaced to define an opening for receiving the keeper-engaging region, wherein the trailing and leading walls are adapted to engage the keeper-engaging region of the latch bolt when the latch bolt is in the locking position;

wherein the latch bolt keeper-engaging region comprises a keeper-striking side which first strikes the keeper leading wall as the latch is closed, and said keeper-striking side comprises a taper narrowing to the keeper-engaging end; and wherein to minimize or eliminate rattling of the latch:

(i) the keeper trailing wall is angled so as to engage the taper when the latch is closed; and (ii) when the latch is closed the biasing mechanism drives the keeper-engaging region of the latch bolt into engagement with both the keeper leading wall and the keeper trailing wall; and wherein when the latch is closed the keeper trailing wall extends towards the mounting body further than the keeper leading wall to thereby assist in closing the latch.

2. The latch of claim 1, wherein the latch bolt keeper-striking side is tapered to an angle of about 4 to 20 degrees relative to the longitudinal axis.

3. The latch of claim 2, wherein the latch bolt keeper-striking side is tapered to an angle of about 4 to 15 degrees relative to the longitudinal axis.

4. The latch of claim 1, wherein the latch bolt keeper-striking side is tapered for approximately 3 to 12 mm, as measured along the longitudinal axis from the keeper-engaging end.

5. The latch of claim 1, wherein the keeper trailing wall is angled to about 4 to 20 degrees relative to the longitudinal axis of the latch bolt.

6. The latch of claim 5, wherein the keeper trailing wall is angled to about 4 to 15 degrees relative to the longitudinal axis of the latch bolt.

7. The latch of claim 1, wherein the latch bolt keeper-engaging region comprises a second side opposite to the keeper-striking side, and wherein the second side is planar and the keeper leading wall which engages said second side is planar.

8. The latch of claim 1, wherein the trailing and leading walls of the keeper are oriented to conform to the shape of the keeper-engaging region.

9. The latch of claim 1, further comprising:

a handle; and the latch bolt positioner is for moving the latch bolt between the locking position and unlocking position, the latch bolt positioner being operably connected to the latch bolt and handle, and the latch bolt positioner comprising a cam and a cam follower so that as the cam bears against the cam follower the latch bolt moves between the locking position and the unlocking position.

10. The latch of claim 9, wherein the cam is connected to the handle, and the cam follower is connected to the latch bolt.

11. The latch of claim 10, wherein the cam is in the form of a latch bolt actuator pivotally connected to the mounting body, and the cam follower is in the form of a roller pinned to the latch bolt.

12. The latch of claim 9, wherein the latch bolt comprises a slot and the cam follower is positioned within the slot.

13. The latch of claim 1, wherein the latch bolt comprises a slot, and the biasing mechanism is positioned within the slot.

14. The latch of claim 1, wherein the latch bolt has a cuboid shape.

15. The latch of claim 1, wherein the keeper engaging region of the latch bolt has a cylindrical shape.

16. The latch of claim 1, wherein the leading wall of the keeper has a sloped or ramped outer surface along which the latch bolt keeper-striking side slides when moving to the keeper opening.

17. The latch of claim 1, wherein the keeper comprises a base extending between the trailing and leading walls, and when the latch is closed the latch bolt keeper-engaging end does not come into contact with the base.

18. The latch of claim 1, wherein the latch is mountable to a door or panel, and the latch is capable of withstanding a load transverse to the longitudinal plane of the door or panel of at least about 250 kg.

19. The latch of claim 1, wherein the latch bolt has a longitudinal axis and is in slideable engagement with the mounting body for axial movement relative to the mounting body between the locking position and the unlocking position.

20. The latch of claim 1, wherein when the latch bolt is in the unlocking position the keeper engaging region is able to move past the keeper trailing wall.

* * * * *